US010934079B2

(12) United States Patent
Jancisin

(10) Patent No.: US 10,934,079 B2
(45) Date of Patent: Mar. 2, 2021

(54) CLEANING MECHANISM FOR SPRAY AND AEROSOL NOZZLES

(71) Applicant: Derek S. Jancisin, Pittsburgh, PA (US)

(72) Inventor: Derek S. Jancisin, Pittsburgh, PA (US)

( * ) Notice: Subject to any disclaimer, the term of this patent is extended or adjusted under 35 U.S.C. 154(b) by 0 days.

(21) Appl. No.: 16/812,519

(22) Filed: Mar. 9, 2020

(65) Prior Publication Data

US 2020/0317429 A1 Oct. 8, 2020

Related U.S. Application Data

(60) Provisional application No. 62/817,088, filed on Mar. 12, 2019.

(51) Int. Cl.

| | |
|---|---|
| ***B65D 83/34*** | (2006.01) |
| ***B65D 83/20*** | (2006.01) |
| ***B65D 83/28*** | (2006.01) |

(52) U.S. Cl.

CPC ..... *B65D 83/34* (2013.01); *B65D 83/205* (2013.01); *B65D 83/28* (2013.01)

(58) Field of Classification Search

CPC ..... B65D 83/205; B65D 83/28; B65D 15/52; B65D 83/40; B65D 83/34; B65D 83/345

See application file for complete search history.

(56) References Cited

U.S. PATENT DOCUMENTS

| | | | | |
|---|---|---|---|---|
| 372,899 | A * | 11/1887 | Dorwart | B65D 47/265 222/542 |
| 2,061,462 | A * | 11/1936 | Groman | B65D 47/263 222/542 |
| 2,581,289 | A * | 1/1952 | Prevost | B05B 1/042 239/116 |
| 4,636,102 | A | 1/1987 | Drake | |
| 4,944,458 | A * | 7/1990 | Sassenberg | B65D 83/20 222/542 |
| 5,549,209 | A | 8/1996 | Weissman et al. | |
| 6,321,688 | B1 * | 11/2001 | Eriksson | A01J 7/04 119/651 |
| 7,017,782 | B2 * | 3/2006 | Harrold | B65D 35/38 215/222 |
| 8,240,938 | B2 | 8/2012 | Maxwell | |
| 9,078,514 | B2 | 7/2015 | Nalbandian | |
| 2004/0181885 | A1 * | 9/2004 | Aoki | B05B 15/52 15/21.1 |
| 2008/0111004 | A1 * | 5/2008 | Huffman | B05B 1/14 239/114 |
| 2009/0314738 | A1 | 12/2009 | Siacunco et al. | |
| 2017/0247173 | A1 | 8/2017 | Jack et al. | |

* cited by examiner

*Primary Examiner* — Donnell A Long
(74) *Attorney, Agent, or Firm* — Mark Andrew Mazza

(57) ABSTRACT

A cleaning mechanism for spray and aerosol nozzles comprising a cap and a plurality of cleaning members where the cleaning members are affixed to the internal surface of the cap in one or more different arrangements covering at least a portion of each of the vertical height of the internal surface and the internal circumference. The cleaning mechanism may be configured as fixed within a cap or as a standalone cap attachment that is inserted and/or detached from the cap for use. The cleaning members may comprise brush members, plastic members, or members made of other materials.

26 Claims, 23 Drawing Sheets

CLEANING MECHANISM FOR SPRAY AND AEROSOL NOZZLES

CROSS REFERENCE TO RELATED APPLICATIONS

This application claims priority under 35 U.S.C. § 119(e) to U.S. Provisional Patent Application No. 62/817,088 filed on Mar. 12, 2019, entitled "Sprayer Cleaning Mechanism and Method," which is hereby incorporated by reference in its entirety.

BACKGROUND

Canisters are commonly used to house various types of liquids and gels such as toiletries, paints, cleaners, cosmetics, cooking oils, chemicals, and other materials. These liquids are then expelled through one or more nozzles, such as a spray or aerosol, when a user presses an actuator. This design is commonly used in a variety of different industries for both consumer and industrial products due to its ease of use, low cost, and suitability for a wide variety of different liquids.

Each time a liquid is expelled, some of the liquid remains on the outside of the nozzle. Over time, this liquid builds up and hardens, forming a residue that partially or completely blocks or obstructs the openings of the nozzle. This blockage prevents the flow of the liquid and also disrupts the intended spray pattern. Users will often become frustrated with blocked or obstructed nozzles, either because the liquid cannot be expelled from the canister in the desired amount or because the spray pattern becomes unpredictable and the user cannot control where the liquid will land on a given surface. One common example of this is when hairspray residue builds up on a nozzle, the user often has trouble expelling the hairspray even when a substantial amount may be left in the canister. When a spray pattern is disrupted, the user may unintentionally spray the hairspray on their face or in their eyes due to the inability to control where the hairspray will land. This unpredictability becomes more dangerous when the canister contains chemicals or other hazardous materials that can cause physical harm to a user or damage to property. As a result the user will often discard the canister and purchase a new one long before all of the liquid is used. This results in increased cost and waste to the user and also creates a need to replace a product more often.

Current designs for canister caps merely serve to act as a covering for the nozzle. These caps do nothing to prevent the buildup of any residue or assist in cleaning the nozzle when this occurs. If a user wants to clean the nozzle, they need to resort to external brushes or other cleaning methods. This causes more frustration and takes more time because the user needs to search for a solution and often needs to experiment with different cleaning solutions before finding one that may work. Even if a user finds a suitable cleaning solution, it is often ineffective because it was not specifically designed or intended for use in cleaning nozzles.

There exists a need for a cleaning mechanism that can be used to periodically clean nozzles after use to prevent the buildup of residue and prolong the useful life of products housed in canisters. The cleaning mechanism should be efficient, effective, convenient, and low cost to encourage use by a user and also to achieve the desired result of providing a user with a clean nozzle each time they pick up the canister.

SUMMARY OF THE INVENTION

The present disclosure provides for a cleaning mechanism for spray and aerosol nozzles. In one embodiment, the cleaning mechanism may comprise a cap that defines a cavity and comprises an external surface area and an internal surface area. The internal surface area may further comprise a vertical height and an internal circumference. A plurality of cleaning members may be arranged along at least a portion of the vertical height and internal circumference of the internal surface area. These cleaning members may be arranged so that they interact with one or more nozzles of a canister for cleaning.

In another embodiment, a cleaning mechanism may comprise a cap attachment that defines a cavity and comprises an external surface area and an internal surface area. The internal surface area may further comprise a vertical height and an internal circumference. A plurality of cleaning members may be arranged along at least a portion of the vertical height and internal circumference of the internal surface area. These cleaning members may be arranged so that they interact with one or more nozzles of a canister for cleaning.

In another embodiment, the present disclosure provides for an assembly comprising a canister with one or more nozzles and a cap. The cap may define a cavity and comprise an external surface area and an internal surface area. The internal surface area may further comprise a vertical height and an internal circumference. A plurality of cleaning members may be arranged along at least a portion of the vertical height and internal circumference of the internal surface area. These cleaning members may be arranged so that they interact with one or more nozzles of a canister for cleaning.

The present disclosure also provides for a method for cleaning one or more nozzles. The method may comprise providing a cleaning mechanism, where the cleaning mechanism defines a cavity and comprises an external surface area and an internal surface area, and a plurality of cleaning members arranged along at least a portion of the vertical height and internal circumference of the internal surface area and configured to interact with the one or more nozzles of a canister. The cleaning mechanism may be affixed to the canister in a manner that permits the cleaning members to make contact with the one or more nozzles and moving the cleaning mechanism in at least one of a vertical, horizontal, and rotational manner so that the cleaning members clean the nozzle.

The cleaning mechanism, assembly, and method of the present disclosure are advantageous over the prior art because they provide for an efficient, effective, convenient, and low cost cleaning mechanism that can be used to periodically clean nozzles. Providing for a clean nozzle ensures that the liquid is expelled in the desired amount and lands at the desired location on a given surface. The cleaning mechanism also holds potential for prolonging the lifespan of canisters which saves the user time, money, and frustration and also leads to less waste because the user will use more of the liquid before discarding it to purchase a new one.

BRIEF DESCRIPTION OF THE DRAWINGS

The accompanying drawings, which are included to provide further understanding of the disclosure and are incorporated in and constitute a part of this specification illustrate embodiments of the disclosure, and together with the description, serve to explain the principles of the disclosure.

In the drawings:

FIG. 2A is a cross sectional side view of the cap and FIG. 2B is a cross sectional top view of the cap.

FIG. 3A is a cross sectional side view of the cap and FIG. 3B is a cross sectional top view of the cap.

FIG. 4A is a cross sectional side view of the cap and FIG. 4B is a cross sectional top view of the cap.

FIG. 5A is a cross sectional side view of the cap and FIG. 5B is a cross sectional top view of the cap.

FIG. 6A is a cross sectional side view of the cap and FIG. 6B is a cross sectional top view of the cap.

FIG. 7A is a cross sectional side view of the cap and FIG. 7B is a cross sectional top view the cap.

FIG. 8A is a cross sectional side view of the cap and FIG. 8B is a cross sectional top view of the cap.

FIG. 9A is a cross sectional side view of the cap and FIG. 9B is a cross sectional top view of the cap.

FIG. 10A is a cross sectional side view of the cap and FIG. 10B is a cross sectional top view of the cap.

FIG. 12 A and FIG. 12 B are representative of one embodiment of the present disclosure where the cleaning mechanism is a standalone element (i.e., a cleaning attachment) and brush members cover the internal circumference and vertical height of a cap.

FIG. 13A is a cross sectional side view of the cap and cap attachment and FIG. 13B is a cross sectional top view of the cap attachment.

FIG. 14A is a cross sectional side view the cap and cap attachment and FIG. 14B is a cross sectional top view of the cap attachment.

FIG. 15A is a cross sectional side view of the cap and cap attachment and FIG. 15B is a cross sectional top view of the cap attachment.

FIG. 16A is a cross sectional side view of the cap and cap attachment and FIG. 16B is a cross sectional top view of the cap attachment.

FIG. 17A is a cross sectional side view of the cap and cap attachment and FIG. 17B is a cross sectional top view of the cap attachment.

FIG. 18A is a cross sectional side view of the cap and cap attachment and FIG. 18B is a cross sectional top view of the cap attachment.

FIG. 19A is a cross sectional side view of the cap and cap attachment and FIG. 19B is a cross sectional top view of the cap attachment.

FIG. 20A is a cross sectional side view of the cap and cap attachment and FIG. 20B is a cross sectional top view of the cap attachment.

DETAILED DESCRIPTION

Reference will now be made in detail to the embodiments of the present disclosure, examples of which are illustrated in the accompanying drawings. Wherever possible, the same reference numbers will be used throughout the specification to refer to the same or like parts.

The present disclosure provides for a cleaning mechanism, assembly, and method for cleaning spray and aerosol nozzles. FIG. 1-FIG. 10B are representative of one embodiment of the present disclosure where a cap for a canister is be configured with a cleaning mechanism inside of the cap. In such an embodiment, the cleaning mechanism is fixed and is not removable. This may be achieved by manufacturing the cap to inherently contain the cleaning mechanism, such as by 3D printing, injection molding, or any other known manufacturing process. In the alternative, the cleaning mechanism may be permanently affixed to the cap after manufacturing using a glue, epoxy, or other adhesive material.

Figure 1:
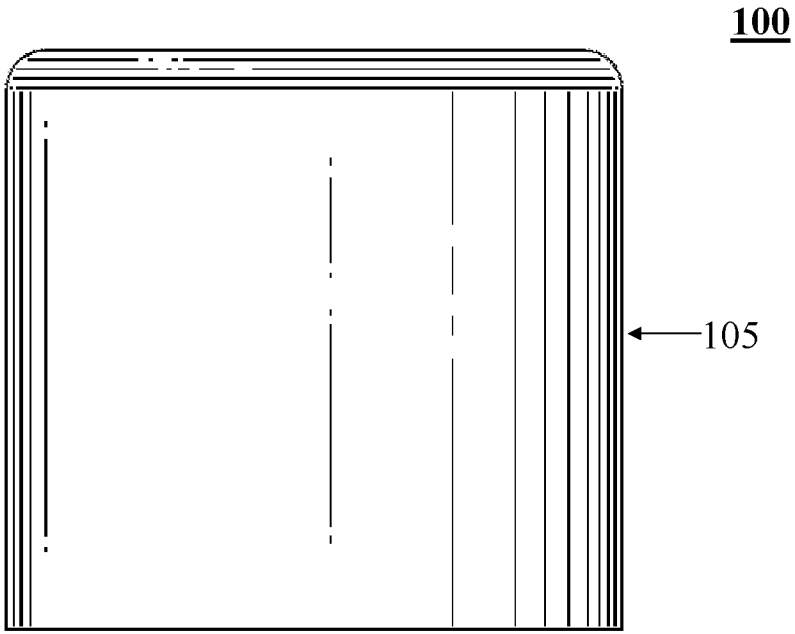
FIG. 1 is representative of one embodiment of the present disclosure where a cap for a spray or aerosol can is fixed with a cleaning mechanism.

Referring first to FIG. 1, a cap 100 is designed with the cleaning mechanism affixed to the inside of the cap and may not be visible from the outside (external surface area 105), providing a clean and streamlined appearance. In one embodiment, a cleaning mechanism may comprise a cap that defines a cavity and comprises an external surface area and an internal surface area, where the internal surface area further comprises a vertical height and an internal circumference. A plurality of cleaning members may be arranged along at least a portion of the vertical height and internal circumference of the surface area, where the plurality of cleaning members are configured to interact with the one or more nozzles of a canister for cleaning. While the present disclosure describes the various embodiments as being associated with at least one of a spray nozzle and an aerosol nozzle, it is contemplated that the cleaning mechanism, assembly, and method described herein may be configured to apply to other types of nozzles as well. The cleaning members may further comprise at least one of brush members, plastic members, and combinations thereof and may be selected based on what material is most appropriate for cleaning the type of liquid that will be housed in the canister. Other materials may also be used provided such materials are arranged or configured in a similar manner and are capable of effectively cleaning a nozzle. The type of nozzle, design of the canister, and intended application for the product contained in the canister may also impact the best arrangement and material to use for the cleaning members.

Figure 2B:
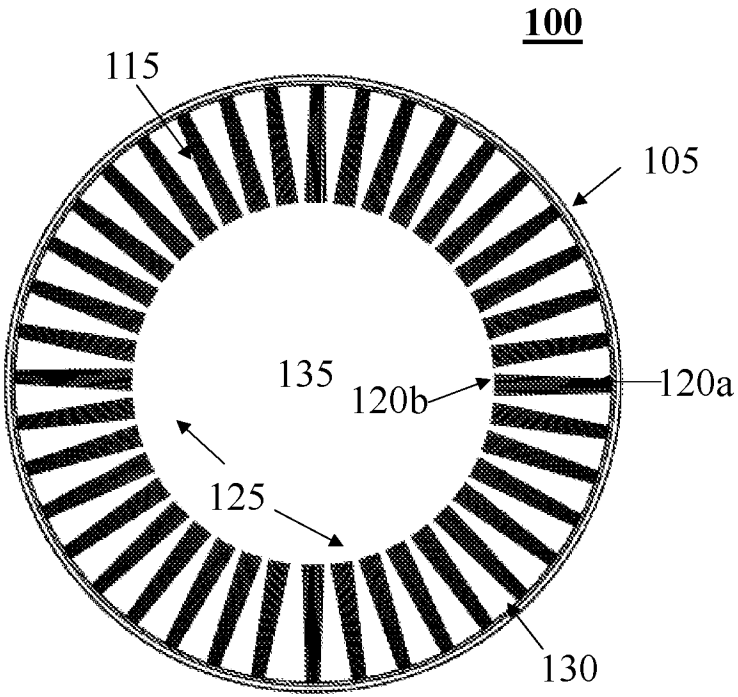
FIG. 2A and FIG. 2B are representative of one embodiment of the present disclosure where brush members cover the internal circumference and vertical height of a cap.
Figure 2A:
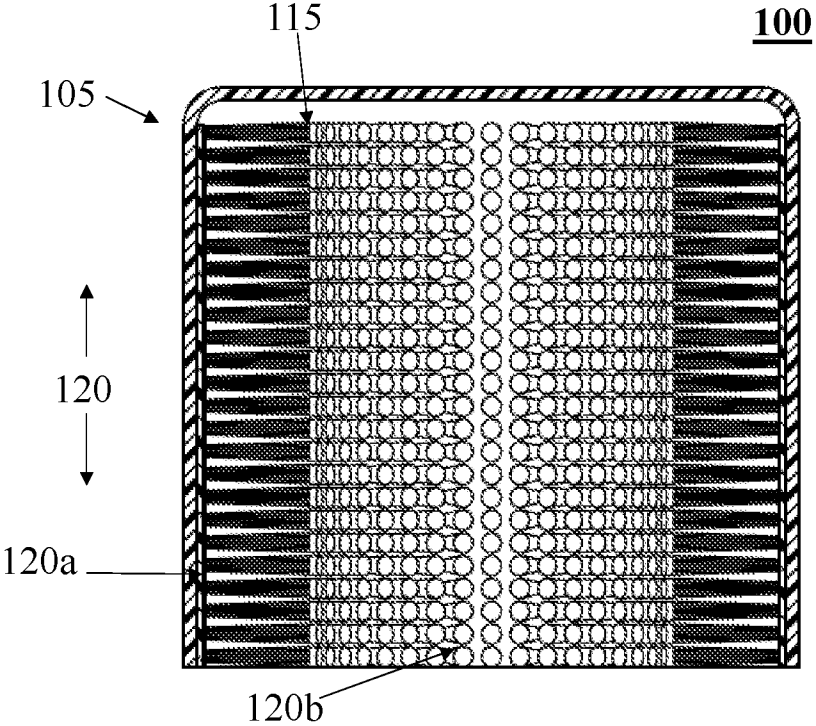

Such an embodiment may be configured in a number of ways based on the structure or arrangement of the canister and nozzle, the chemical and physical properties of the contents of the canister, and the desired method and quality of cleaning. Different configurations may be achieved through different arrangements of the plurality of cleaning members depending on what configuration will be most effective or useful for a given liquid or product application. In one configuration, the cleaning members may be arranged to cover substantially all of the vertical height and internal circumference of a cap. For example, FIG. 2A and FIG. 2B, illustrate a configuration implementing brush members as the cleaning members. Here, the configuration provides for arranging the plurality of brush members 115 to cover substantially all of the vertical height 120 and the internal circumference 125 of the internal surface area 130. Each brush member 115 may have a first portion 120*a* that is affixed to the internal surface area 130 and a second portion 120*b* that is open to the cavity 135 defined by the cap 100.

Figure 3B:
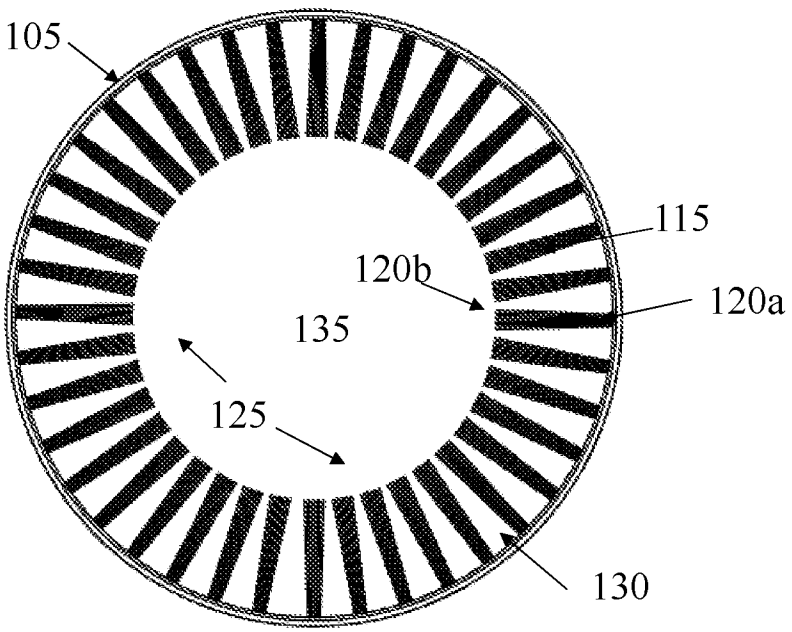
FIG. 3A and FIG. 3B are representative of one embodiment of the present disclosure where brush members cover the internal circumference and vertical height of a cap in spiral configuration.
Figure 3A:
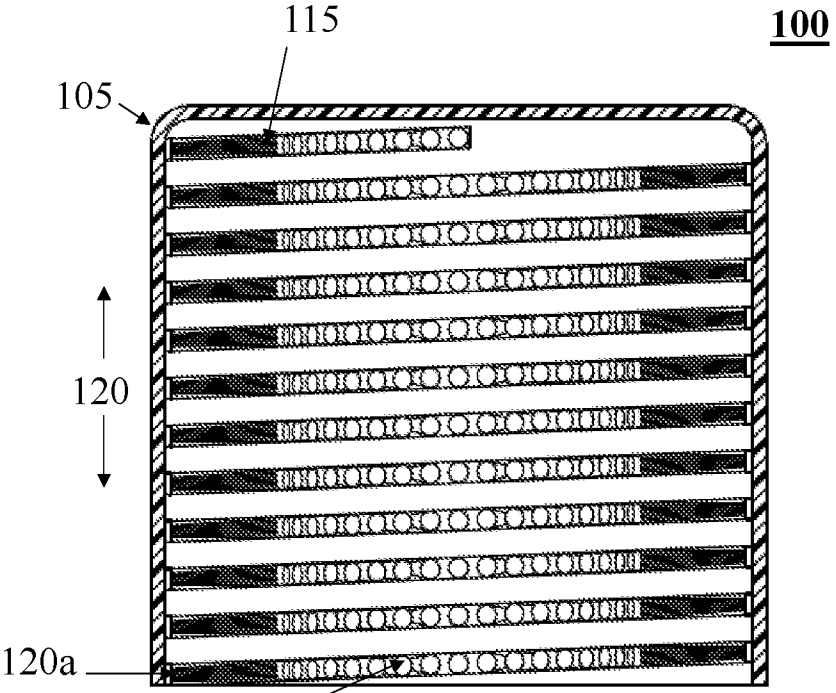

Another configuration, illustrated by FIG. 3A and FIG. 3B provides for arranging the plurality of brush members 115 to cover substantially all of the vertical height 120 and the internal circumference 125 of the internal surface area 130 in a spiral configuration. Each brush member 115 may have a first portion 120*a* and a second portion 120*b* where the first portion is affixed to the internal surface area 130 and a second portion is open to the cavity 135 defined by the cap 100. In another embodiment, the brush members may be arranged as a continuous spiral so that there is only one first portion that affixes at one point on the internal surface area 130 and one second portion that is open to the cavity 135. Here, the portion of the brush member 115 between the first portion and the second portion may also be affixed to the internal surface area 130.

Figure 4B:
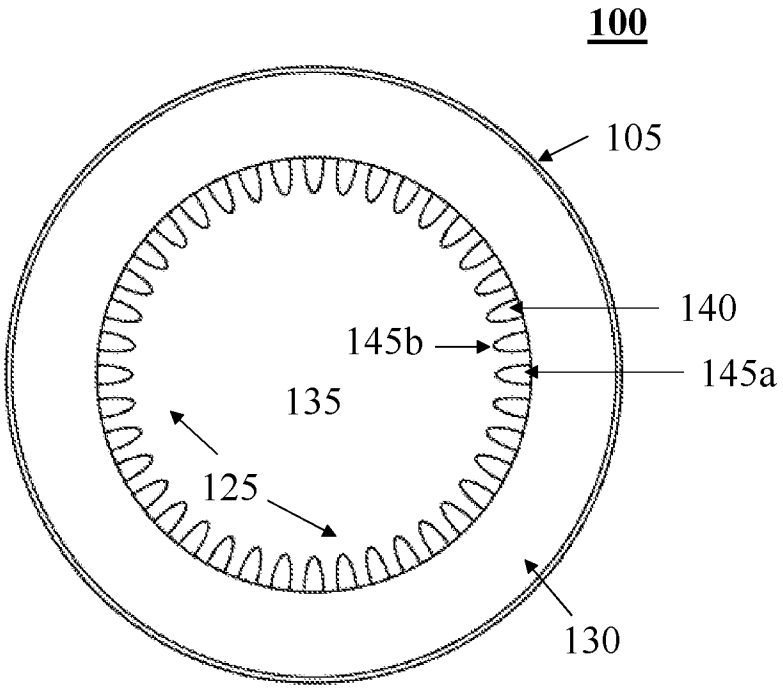
FIG. 4A and FIG. 4B are representative of one embodiment of the present disclosure where plastic members cover the internal circumference and vertical height of a cap.
Figure 4A:
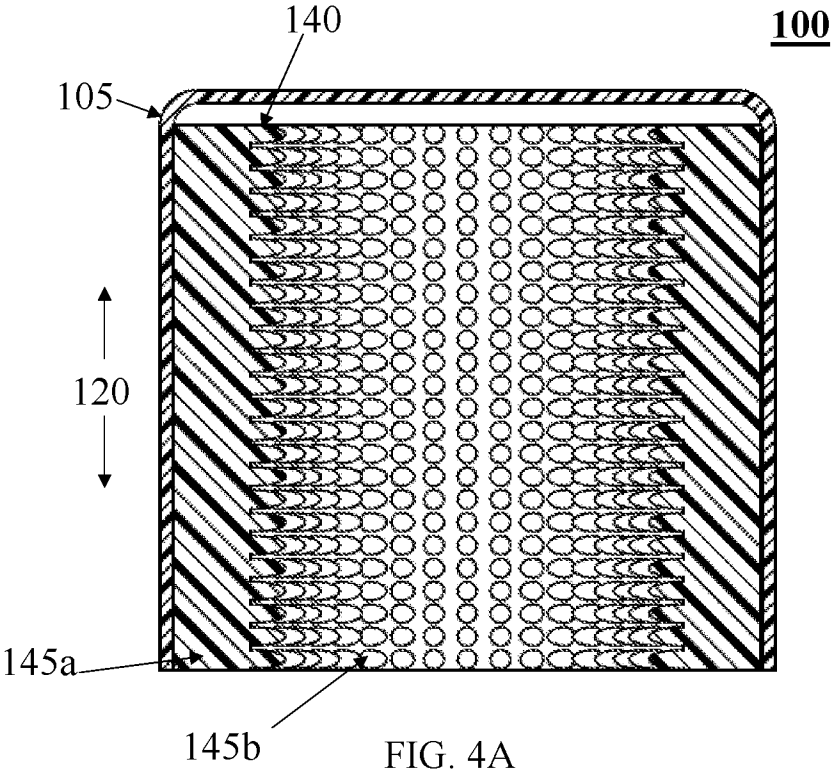

Plastic members may be used as the cleaning members. These plastic members may be arranged in manners similar to those described in connection with the brush members of FIG. 2A-3B. For example, FIG. 4A and FIG. 4B provide for arranging the plurality of plastic members 140 to cover substantially all of the vertical height 120 and the internal circumference 125 of the internal surface area 130. Each plastic member 140 may have a first portion 145*a* that is affixed to the internal surface area 130 and a second portion 145*b* that is open to the cavity 135 defined by the cap 100.

Figure 5B:
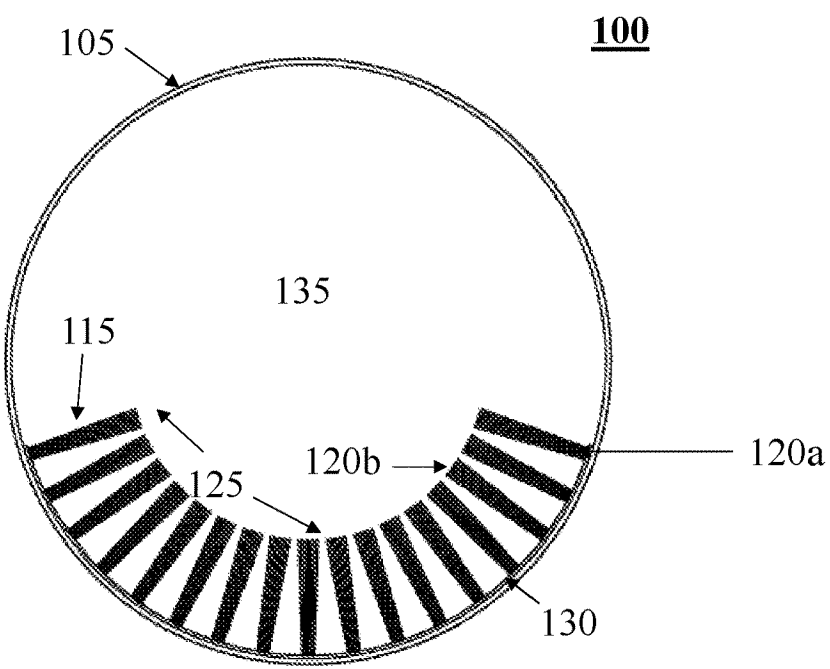
FIG. 5A and FIG. 5B are representative of one embodiment of the present disclosure where brush members cover only a portion of the internal circumference and vertical height of a cap.
Figure 5A:
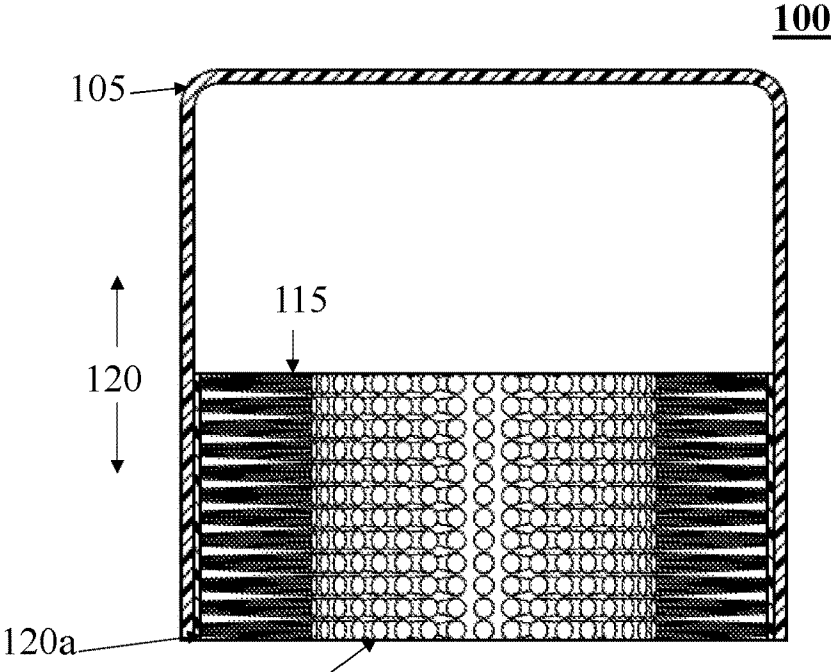
Figure 6B:
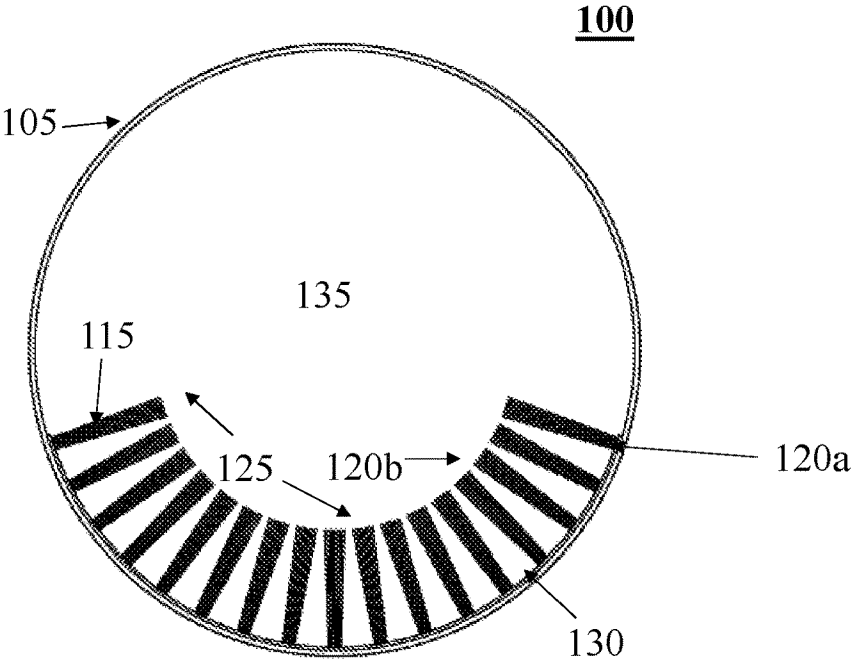
FIG. 6A and FIG. 6B are representative of one embodiment of the present disclosure where brush members cover only a portion of the internal circumference and vertical height of a cap in a spiral configuration.
Figure 6A:
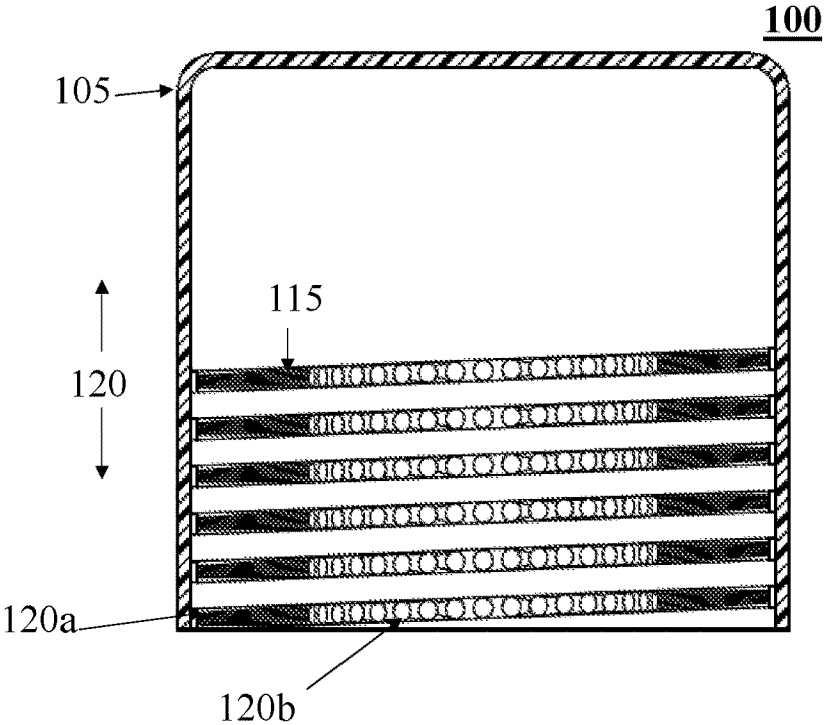
Figure 7B:
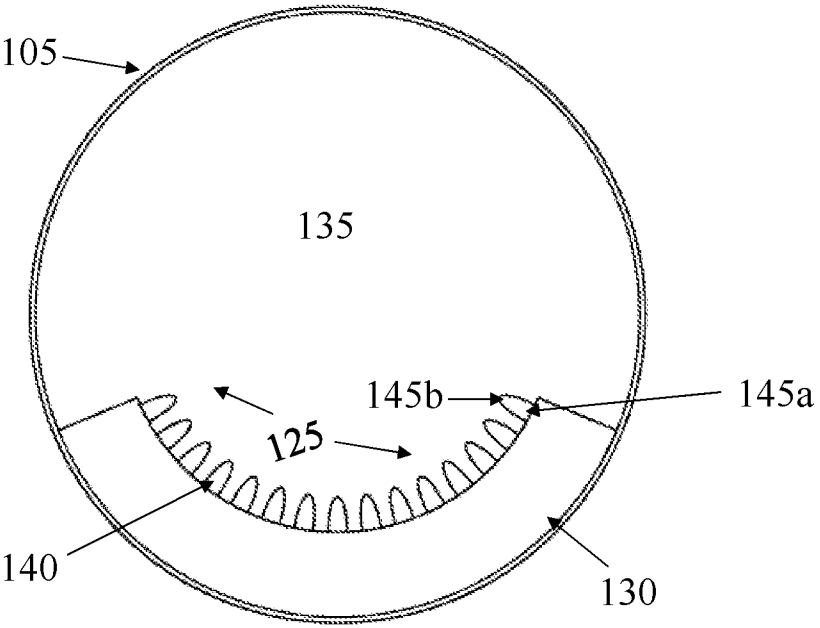
FIG. 7A and FIG. 7B are representative of one embodiment of the present disclosure where plastic members cover only a portion of the internal circumference and vertical height of a cap.
Figure 7A:
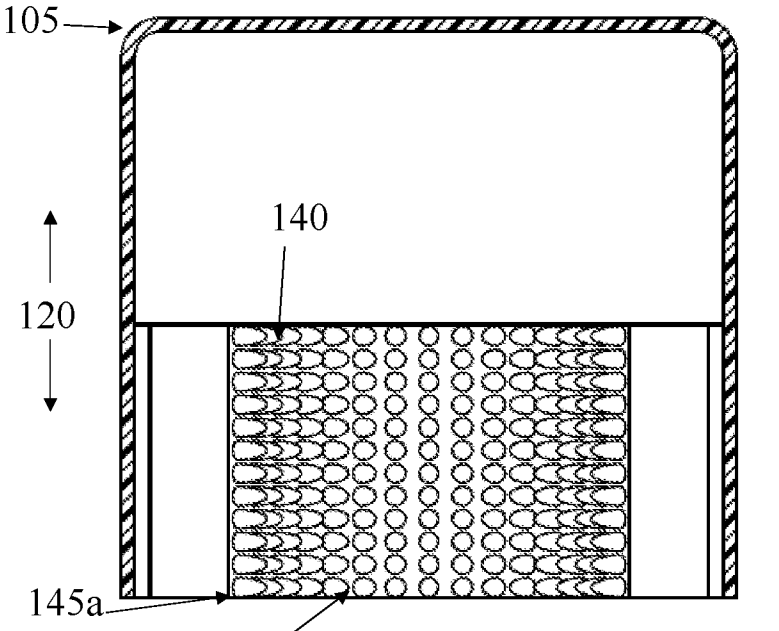

In another configuration, the cleaning members may be arranged so that they cover only a portion of the vertical height and internal circumference of the internal surface area. FIG. 5A and FIG. 5B illustrate such a configuration implementing brush members as the cleaning member. Here, the brush members 115 are arranged to cover only a portion of the vertical height 120 and the internal circumference 125 of the internal surface area 130. In other configurations, brush members 115 may be arranged in a spiral configuration as illustrated by FIG. 6A and FIG. 6B or plastic members may be implemented as illustrated by FIG. 7A and FIG. 7B.

Figure 8B:
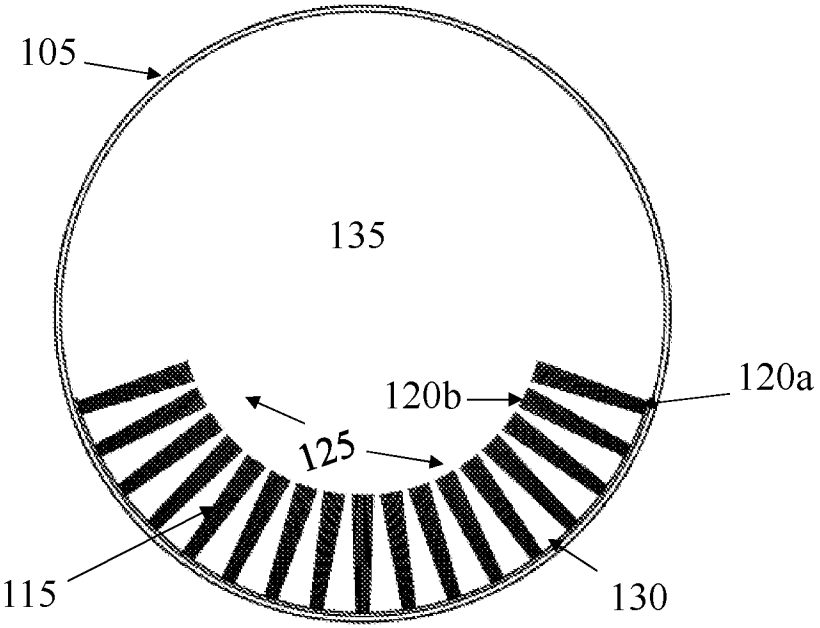
FIG. 8A and FIG. 8B are representative of one embodiment of the present disclosure where brush members cover the vertical height of a cap but only a portion of the internal circumference.
Figure 8A:
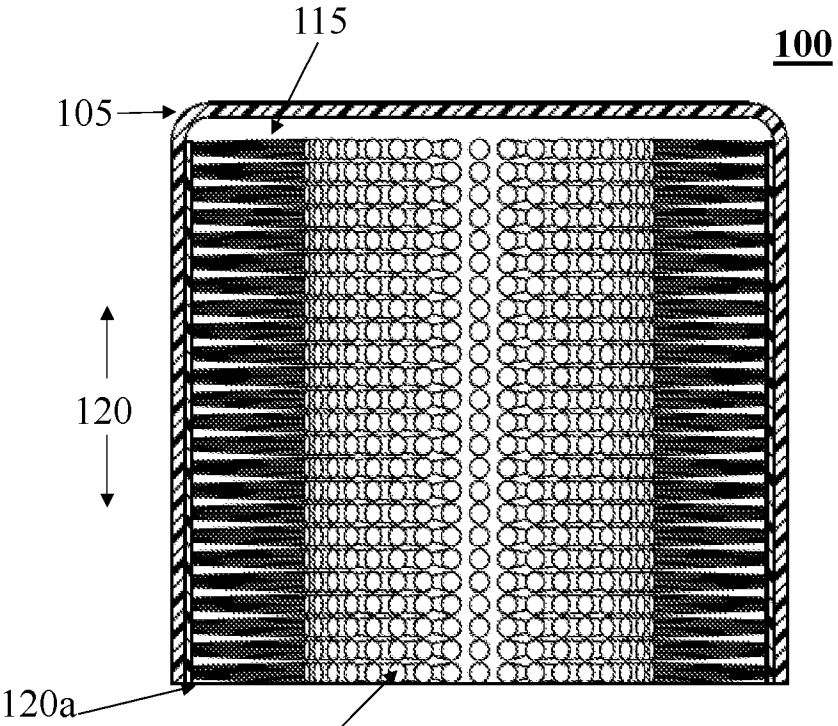
Figure 9B:
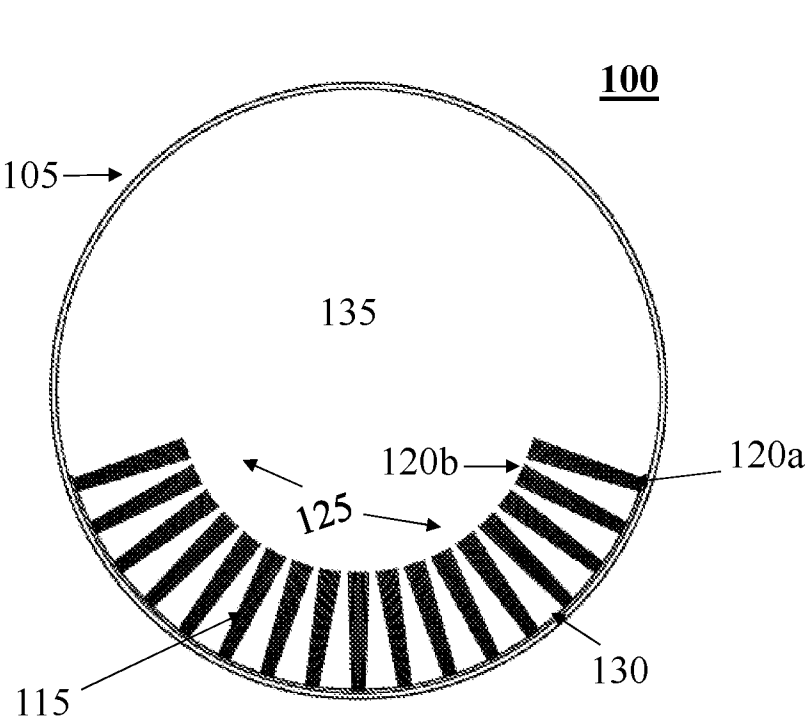
FIG. 9A and FIG. 9B are representative of one embodiment of the present disclosure where brush members cover the vertical height of a cap but, only a portion of the internal circumference of the cap, in a spiral configuration.
Figure 9A:
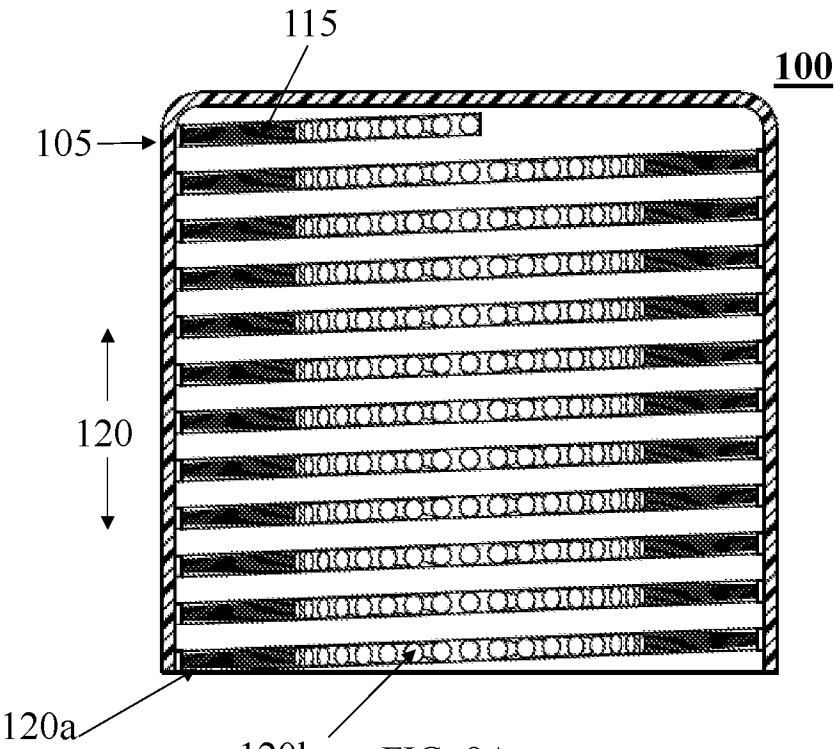
Figure 10B:
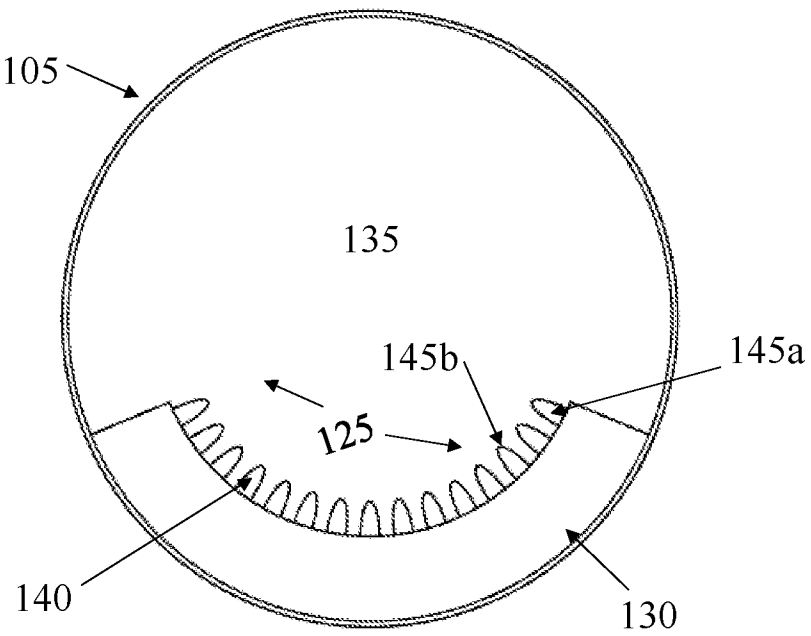
FIG. 10A and FIG. 10B are representative of one embodiment of the present disclosure where plastic members cover the vertical height of a cap but only a portion of the internal circumference of the cap.
Figure 10A:
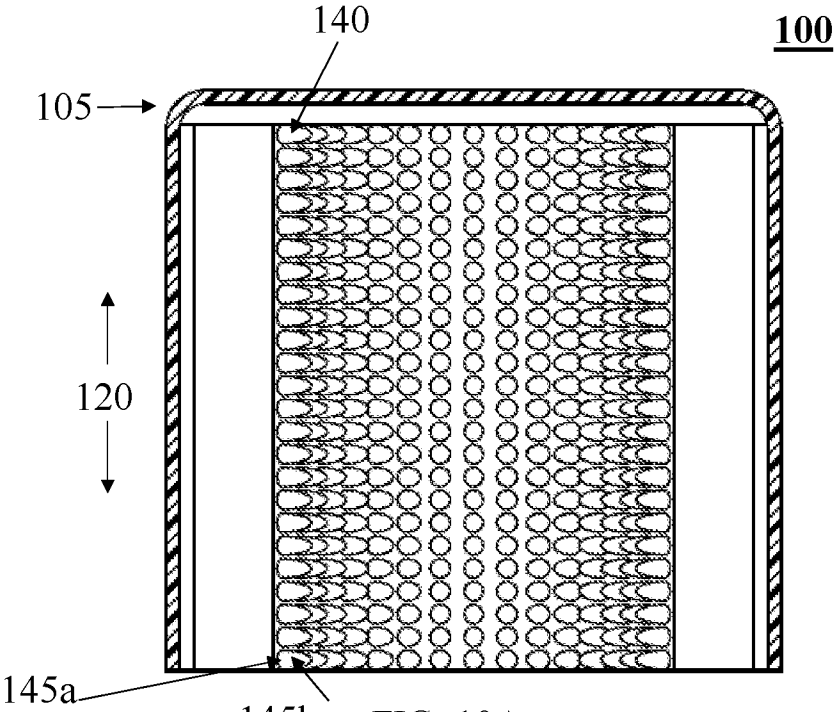

In yet another configuration, the cleaning members may be arranged so that they cover substantially all of the vertical height and only a portion of the internal circumference of the internal surface area. Referring to FIG. 8A and FIG. 8B, a plurality of brush members 115 may be arranged to cover substantially all of the vertical height 120 and the internal circumference 125 of the internal surface area 130. Each brush member 115 may have a first portion 120*a* that is affixed to the internal surface area 130 and a second portion 120*b* that is open to the cavity 135 defined by the cap 100. In other configurations, brush members 115 may be arranged in a spiral configuration as illustrated by FIG. 9A and FIG. 9B or plastic members may be implemented as illustrated by FIG. 10A and FIG. 10B. By arranging the cleaning members so that they only cover a portion of the internal circumference, the configuration provides for more flexibility and range of motion when moving the cap to clean a nozzle. Since not every surface is covered with the cleaning members, the cap can more easily and quickly be moved vertical and horizontal directions and rotated relative to an associated canister to clean the nozzle because there is enough space for the cap to be moved without being slowed down or impeded by continuous contact with the cleaning members.

Figure 11:
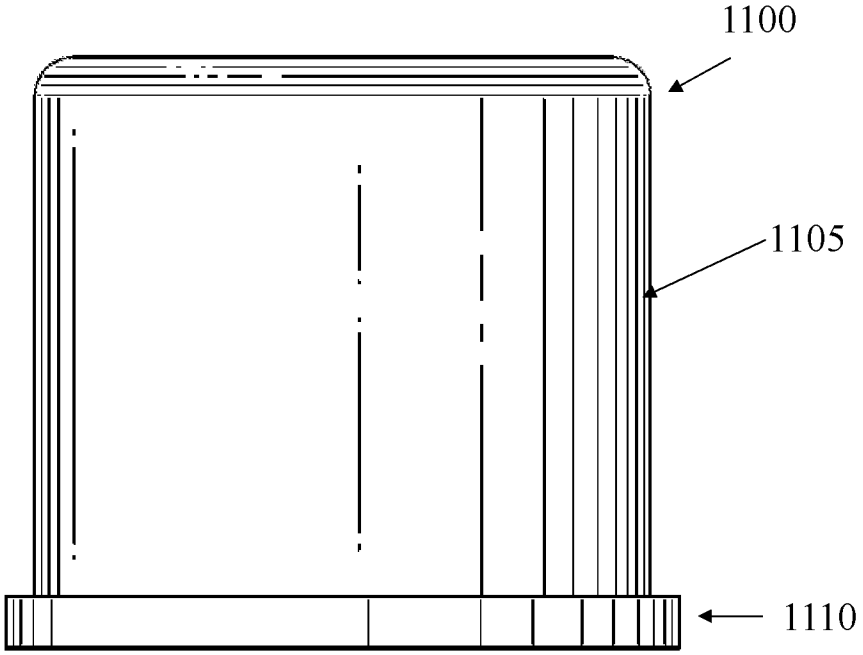
FIG. 11 is representative of one embodiment of the present disclosure where a cleaning mechanism is configured as a standalone element that can be inserted into and detached from a standard cap for a spray or aerosol can.

FIG. 11-20B are representative of another embodiment of the present disclosure where a cap is configured as a standalone element that can be inserted into and detached from a standard cap for a canister. Such an embodiment is illustrated in FIG. 11. Here, a cap attachment 1110 is inserted into a cap 1100 for use. This design enables a user to apply the benefits of a cleaning mechanism as described in connection with FIG. 1-FIG. 10B above to existing caps or caps that are not manufactured with a fixed cleaning mechanism.

In such an embodiment, a cleaning mechanism may comprise a cap attachment that defines a cavity and comprises an external surface area and an internal surface area. The internal surface area may further comprise a vertical height and an internal circumference. A plurality of cleaning members may be arranged along at least a portion of the internal circumference and the vertical height of the internal surface area, where the plurality of cleaning members are configured to interact with one or more nozzles of a canister for cleaning. As described above in connection with an embodiment where the cleaning mechanism is fixed in a cap, a cap attachment may also be used in association with at least one of a spray nozzle, an aerosol nozzle, and other known nozzles. The cleaning members may also similarly comprise at least one of brush members, plastic members, combinations thereof, or other materials.

Figure 12B:
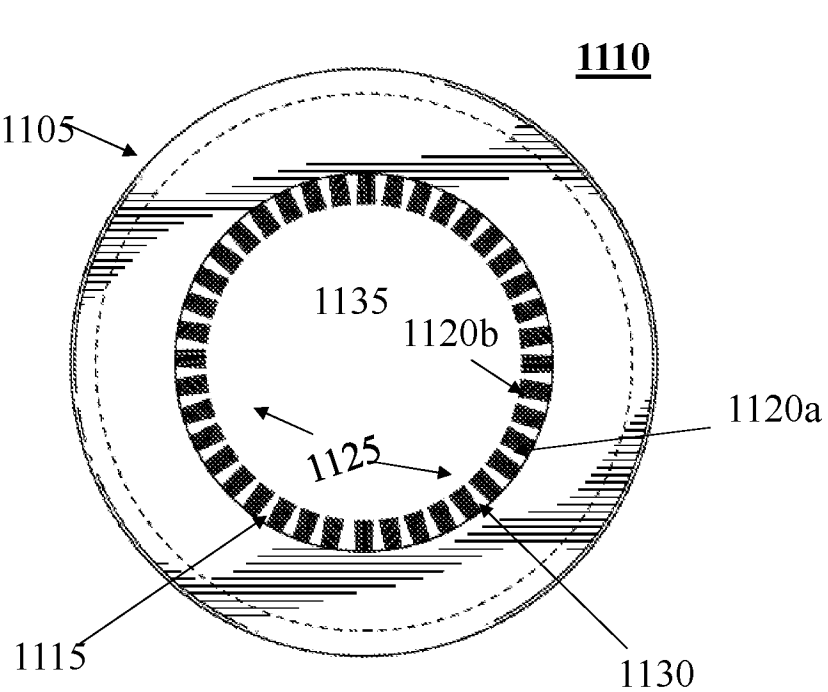
FIG. 12A is a cross sectional side view of the cap and cap attachment and FIG. 12B is a cross sectional top view of the cap attachment.
Figure 12A:
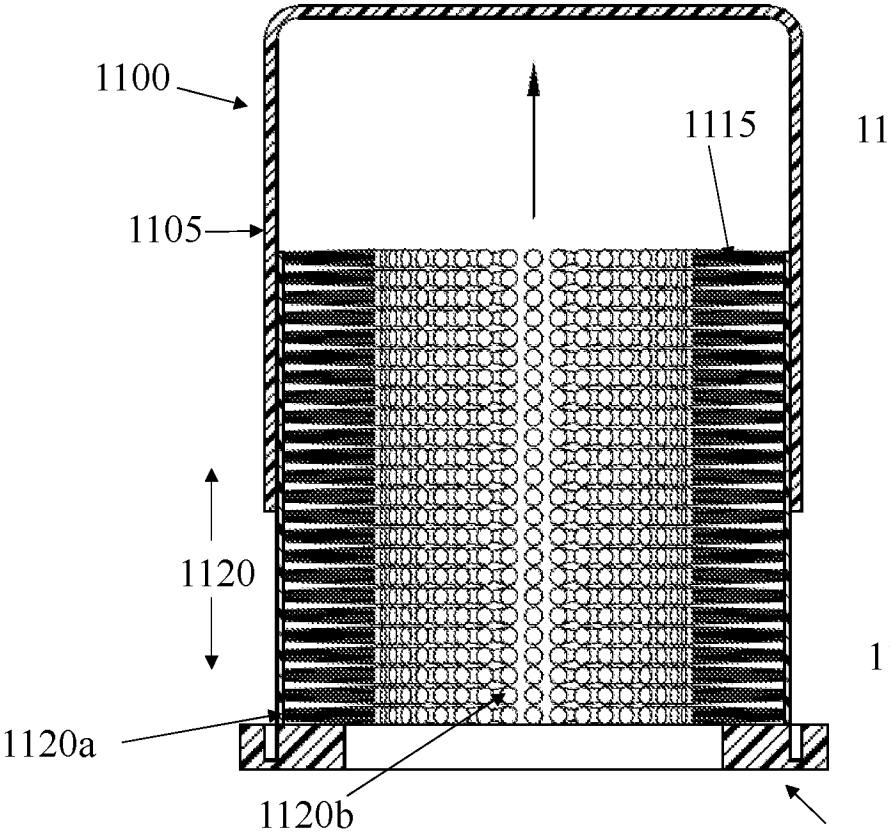

Such an embodiment may be configured in a number of ways, similar to those set forth above in connection with a fixed embodiment, to account for the structure or arrangement of the cap, canister and nozzle, the chemical and physical properties of the contents of the canister, and the desired method and quality of cleaning. In one configuration, the cleaning members may be arranged to cover substantially all of the vertical height and internal circumference of a cap attachment. For example, FIG. 12A and FIG. 12B, illustrate a configuration implementing brush members as the cleaning members. Here, the configuration provides for arranging the plurality of brush members 1115 to cover substantially all of the vertical height 1120 and the internal circumference 1125 of the internal surface area 1130 of the attachment 1110. Each brush member 1115 may have a first portion 1120*a* that is affixed to the internal surface area 1130 and a second portion 1120*b* that is open to the cavity 1135 defined by the cap attachment 1110.

Figure 13B:
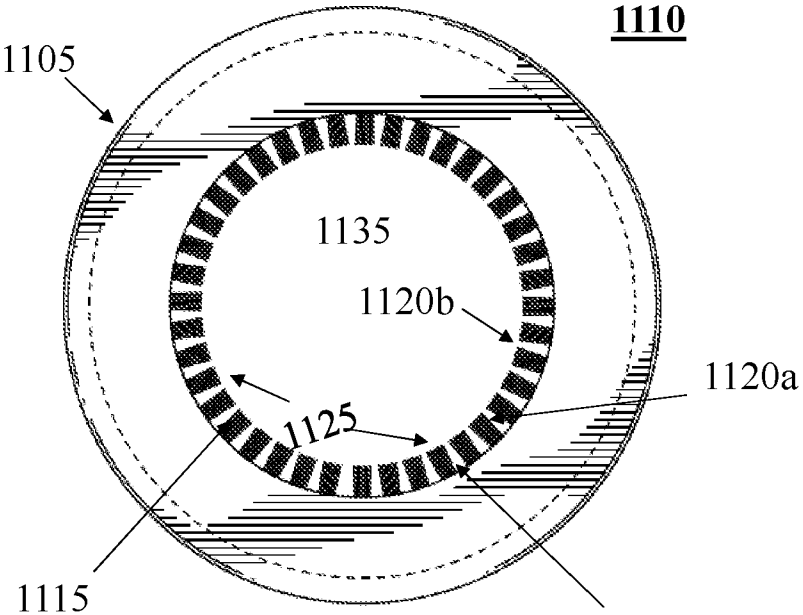
FIG. 13A and FIG. 13B are representative of one embodiment of the present disclosure where the cleaning mechanism is a standalone element and brush members cover the internal circumference and vertical height of a cap in a spiral configuration.
Figure 13A:
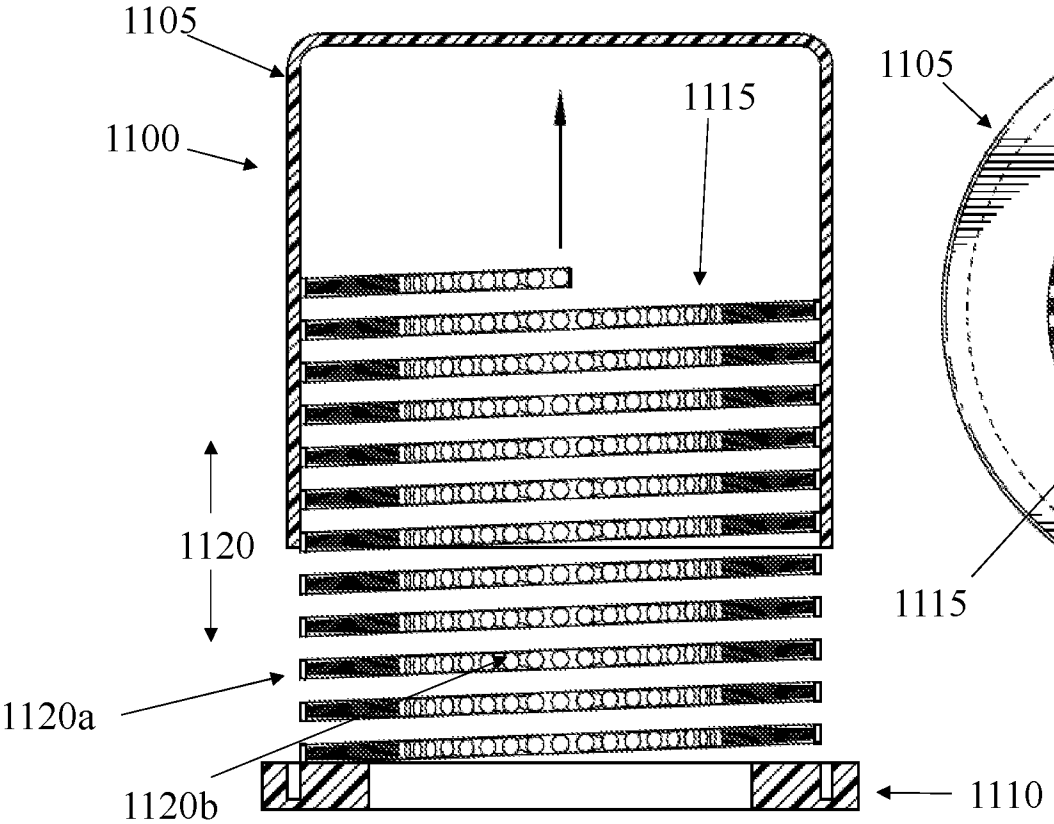

Another configuration, illustrated by FIG. 13A and FIG. 13B provides for arranging the plurality of brush members 1115 to cover substantially all of the vertical height 1120 and the internal circumference 1125 of the internal surface area 1130 in a spiral configuration. Each brush member 1115 may have a first portion 1120*a* and a second portion 1120*b* where the first portion 1120*a* is affixed to the internal surface area 1130 and a second portion 1120*b* is open to the cavity 1135 defined by the cap attachment 1100. In another embodiment, the brush members 1115 may be arranged as a continuous spiral so that there is only one first portion that affixes at one point on the internal surface area 1130 and one second portion that is open to the cavity 1135. Here, the portion of the brush member 1115 between the first portion and the second portion may also be affixed to the internal surface area 1130.

Figure 14B:
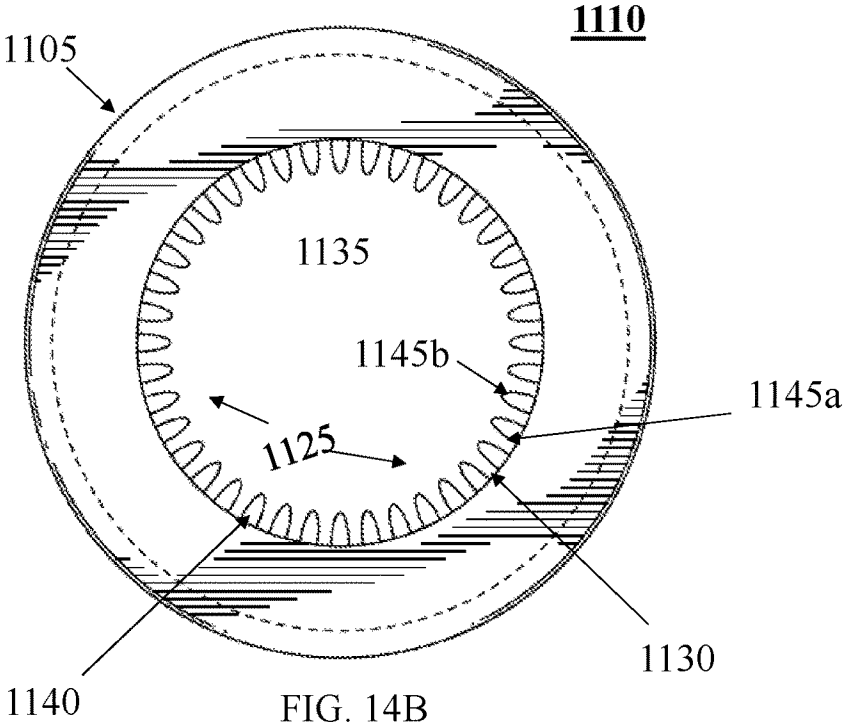
FIG. 14A and FIG. 14B are representative of one embodiment of the present disclosure where the cleaning mechanism is a standalone element and plastic members cover the internal circumference and vertical height of a cap.
Figure 14A:
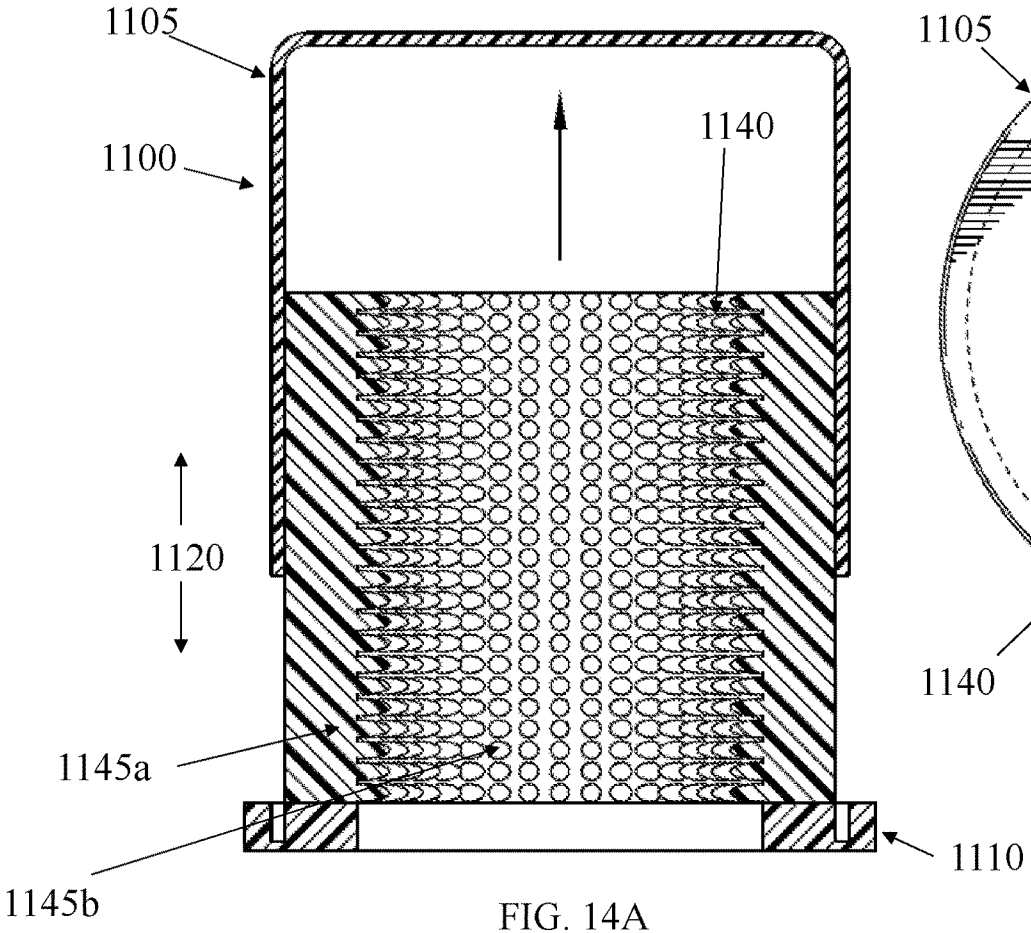

Plastic members may also be implemented and arranged in manners similar to those described in connection with the brush members of FIG. 12A-13B. For example, FIG. 14A and FIG. 14B provide for arranging the plurality of plastic members 1140 to cover substantially all of the vertical height 1120 and the internal circumference 1125 of the internal surface area 1130. Each plastic member 1140 may have a first portion 1145*a* that is affixed to the internal surface area 1130 and a second portion 1145*b* that is open to the cavity 1135 defined by the cap attachment 1100.

Figure 15B:
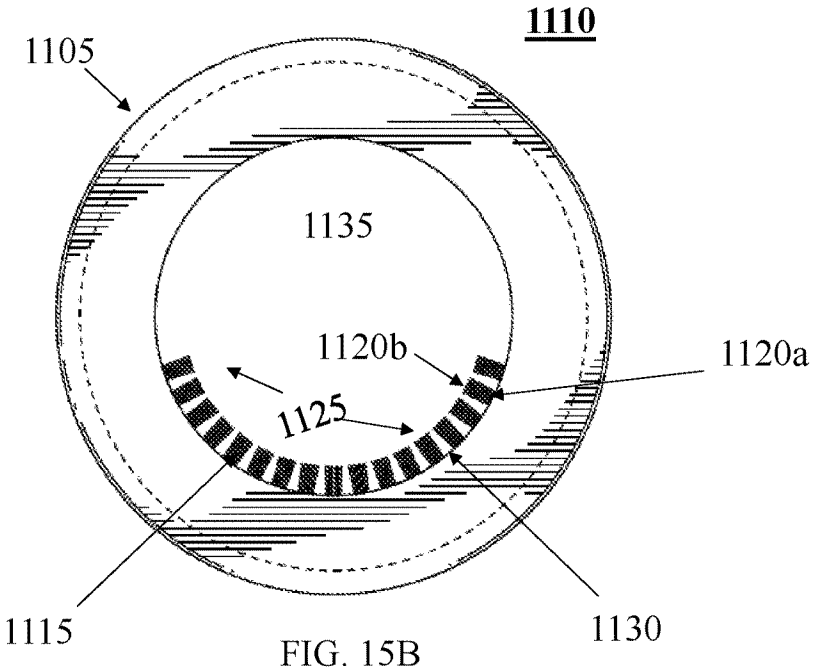
FIG. 15A and FIG. 15B are representative of one embodiment of the present disclosure where the cleaning mechanism is a standalone element and brush members cover only a portion of the internal circumference and vertical height of a cap.
Figure 15A:
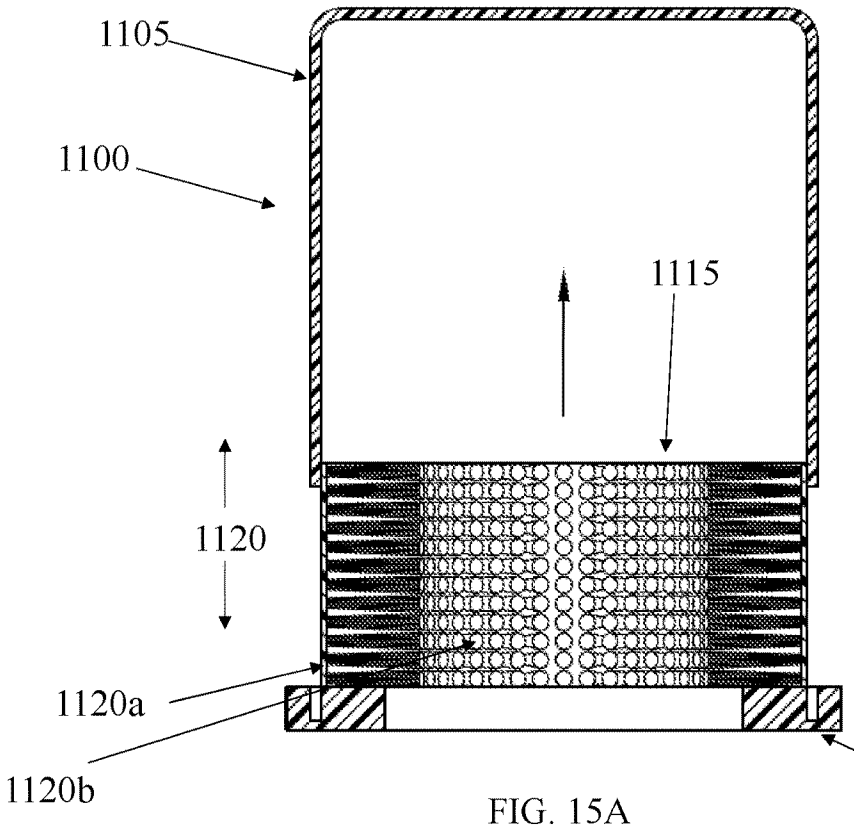
Figure 16B:
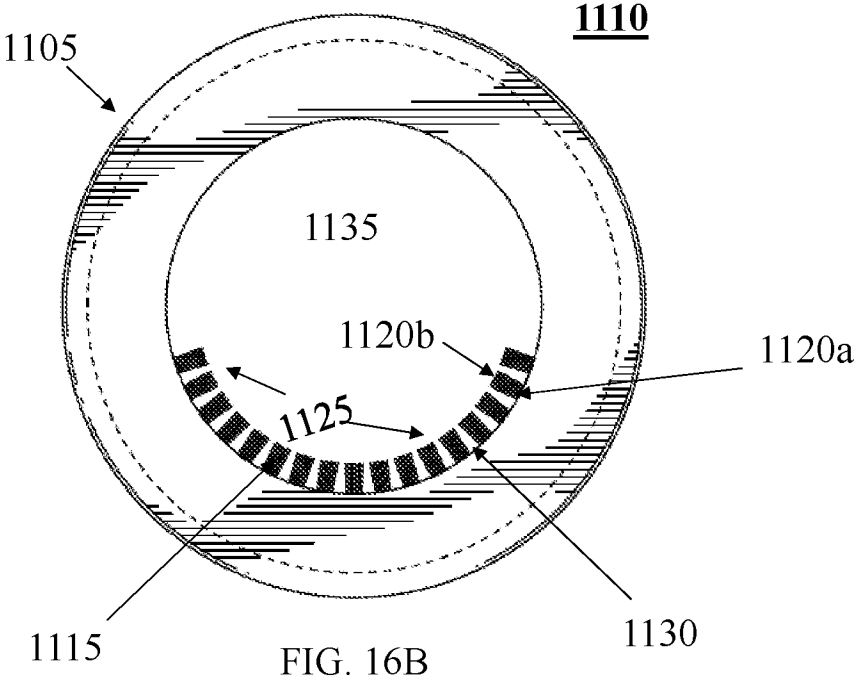
FIG. 16A and FIG. 16B are representative of one embodiment of the present disclosure were the cleaning mechanism is a standalone element and brush members cover only a portion of the internal circumference and vertical height of a cap in a spiral configuration.
Figure 16A:
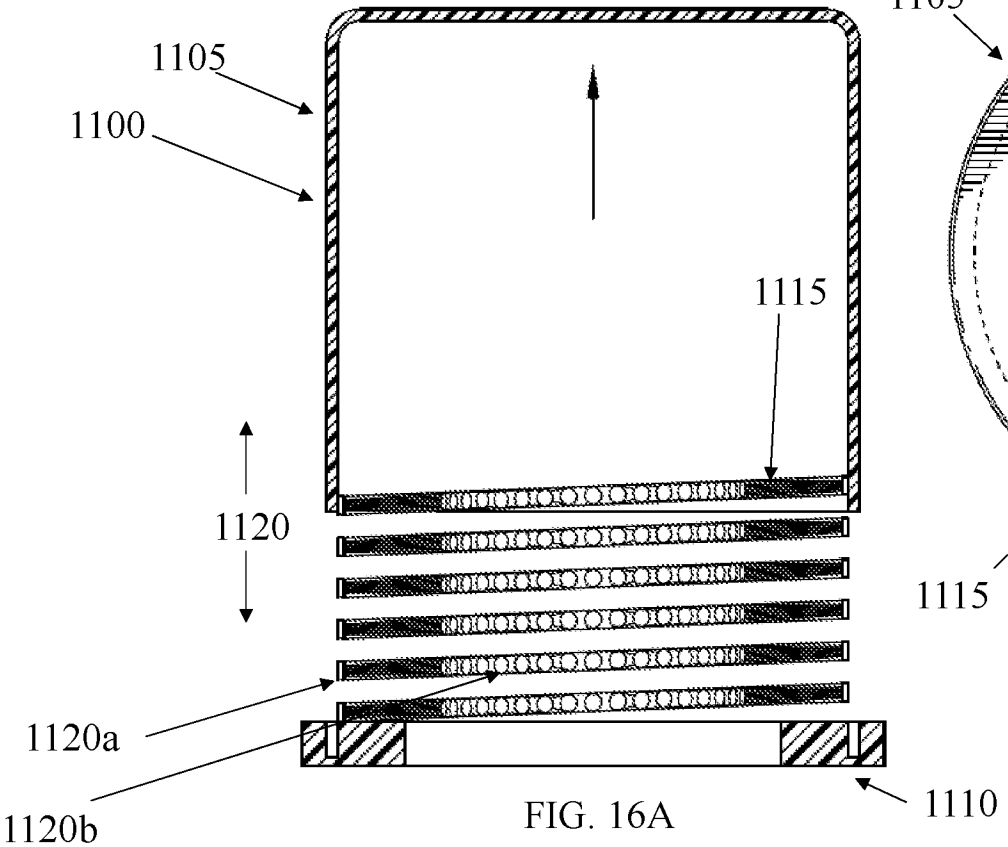
Figure 17B:
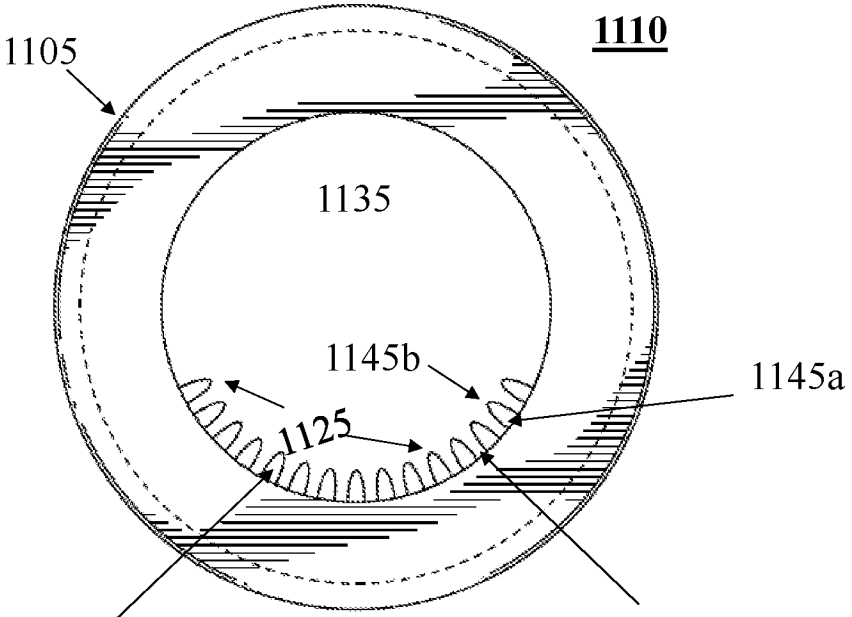
FIG. 17A and FIG. 17B are representative of one embodiment of the present disclosure where the cleaning mechanism is a standalone element and plastic members cover only a portion of the internal circumference and vertical height of a cap.
Figure 17A:
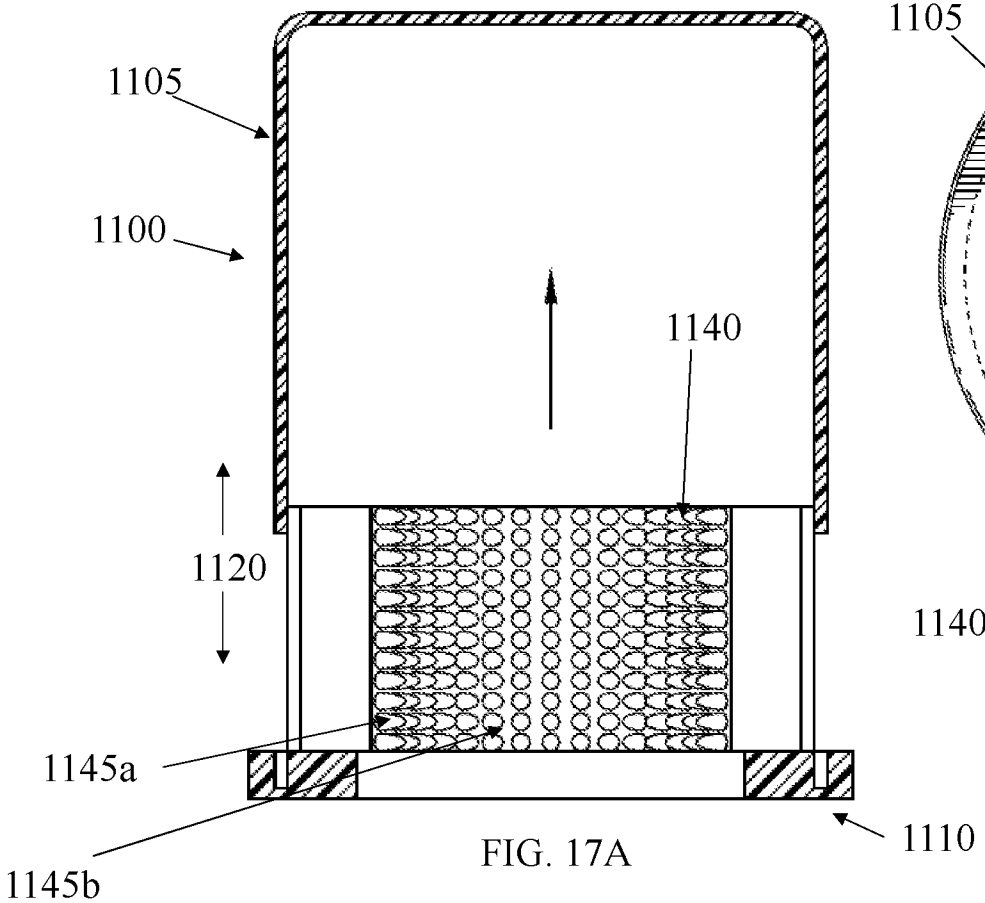

In another configuration, the cleaning members may be arranged so that they cover only a portion of the vertical height and internal circumference of the internal surface area. FIG. 15A and FIG. 15B illustrate such a configuration implementing brush members as the cleaning member. Here, the brush members 1115 are arranged to cover only a portion of the vertical height 1120 and the internal circumference 1125 of the internal surface area 1130. In other configurations, brush members 1115 may be arranged in a spiral configuration as illustrated by FIG. 16A and FIG. 16B or plastic members may be implemented as illustrated by FIG. 17A and FIG. 17B.

Figure 18B:
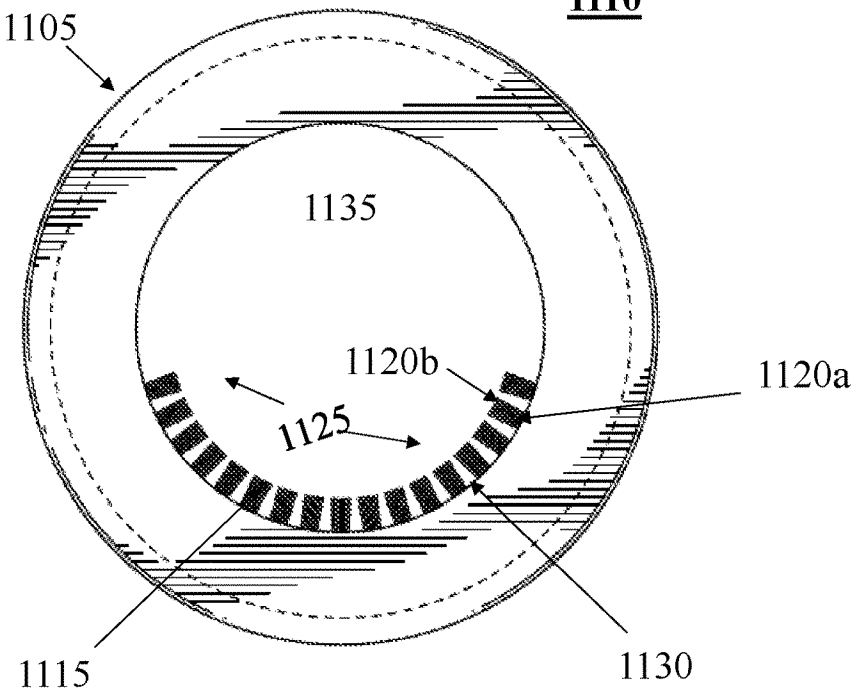
FIG. 18A and FIG. 18B are representative of one embodiment of the present disclosure where the cleaning mechanism is a standalone element and brush members cover the vertical height of a cap but only a portion of the internal circumference.
Figure 18A:
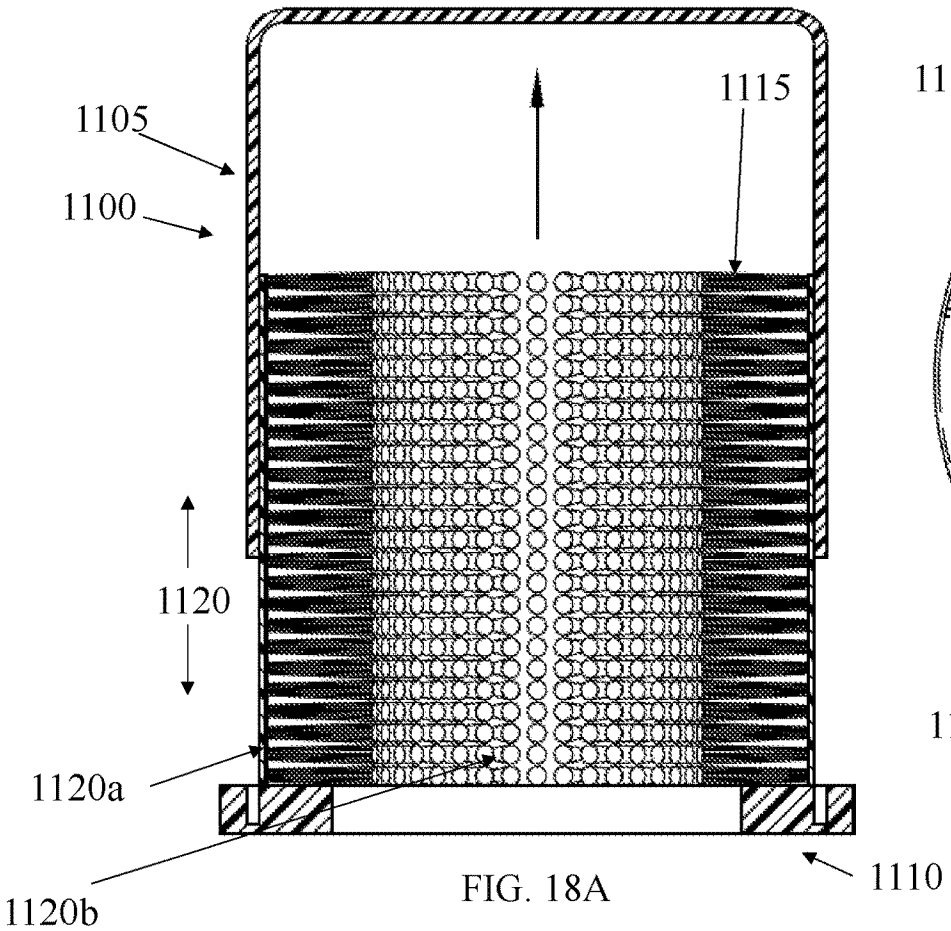
Figure 19B:
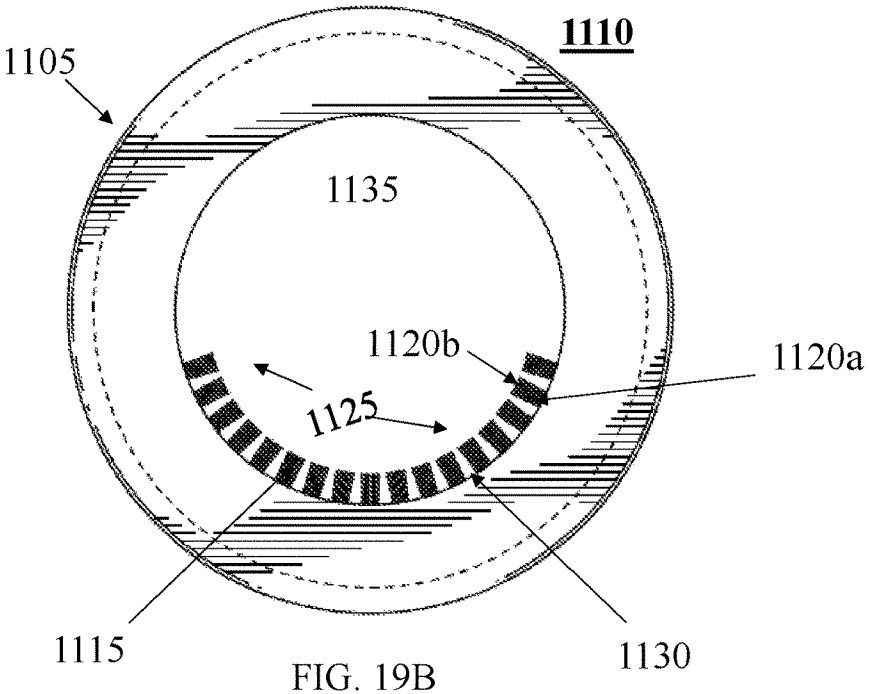
FIG. 19A and FIG. 19B are representative of one embodiment of the present disclosure where the cleaning mechanism is a standalone element and brush members cover the vertical height of the cap, but only a portion of the internal circumference, in a spiral configuration.
Figure 19A:
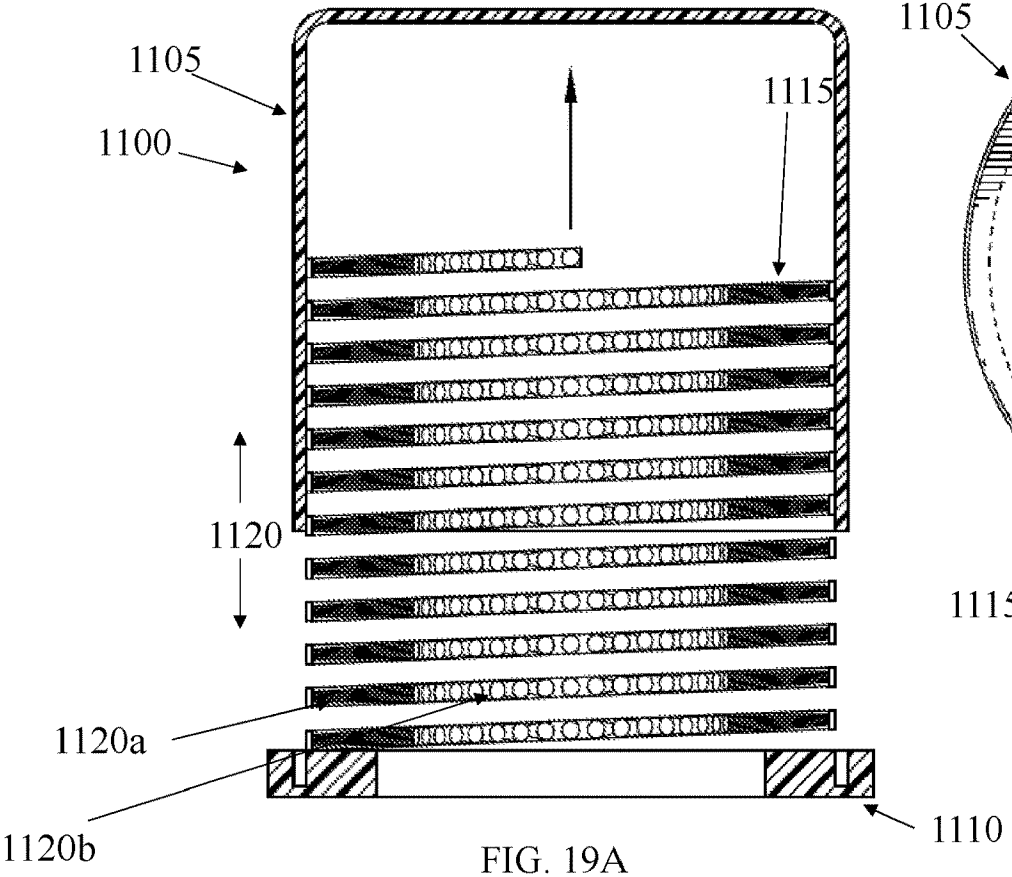
Figure 20B:
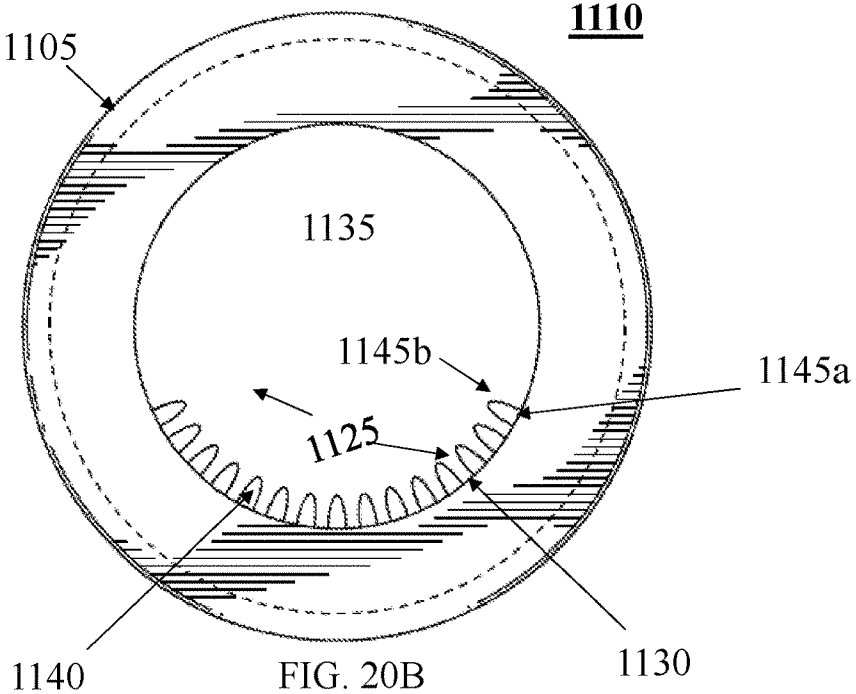
FIG. 20A and FIG. 20B are representative of one embodiment of the present disclosure where the cleaning mechanism is a standalone element and plastic members cover the vertical height of the cap but only a portion of the internal circumference.
Figure 20A:
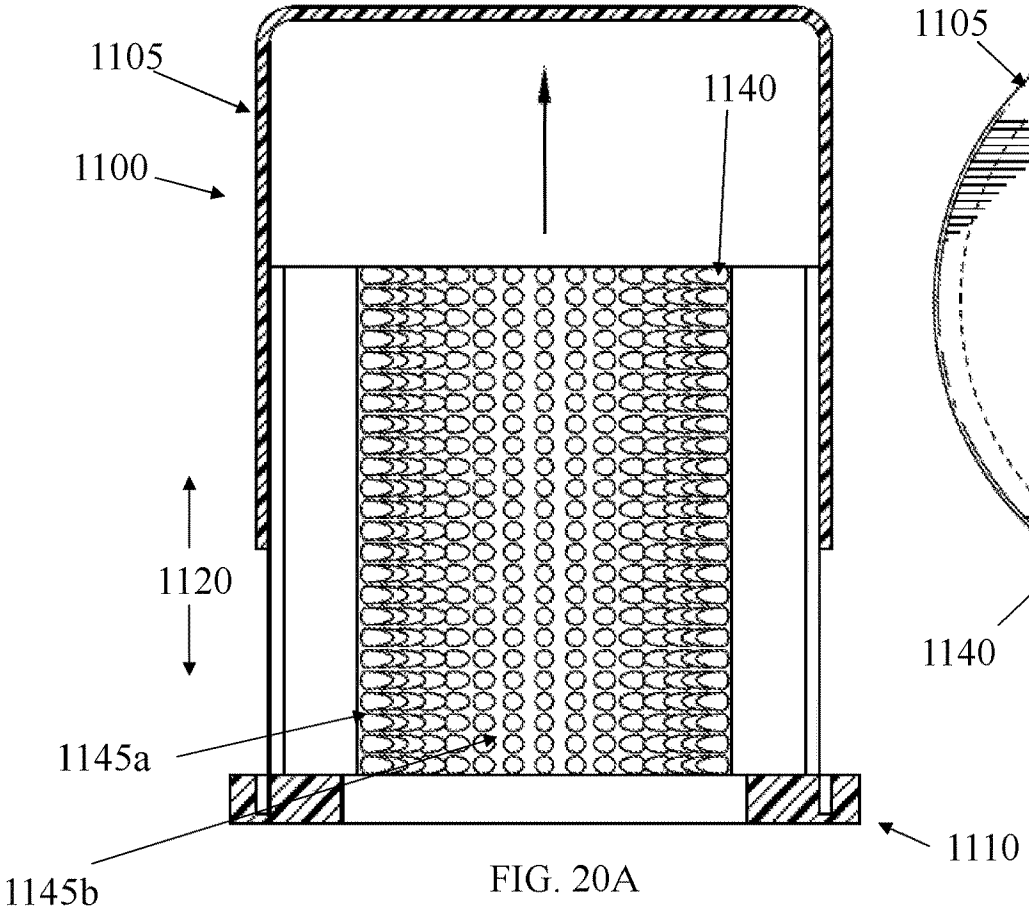

In yet another configuration, the cleaning members may be arranged so that they cover substantially all of the vertical height and only a portion of the internal circumference of the internal surface area. Referring to FIG. 18A and FIG. 18B, a plurality of brush members 1115 may be arranged to cover substantially all of the vertical height 1120 and the internal circumference 1125 of the internal surface area 1130. Each brush member 1115 may have a first portion 1120*a* that is affixed to the internal surface area 1130 and a second portion 1120*b* that is open to the cavity 1135 defined by the cap attachment 1110. In other configurations, brush members 1115 may be arranged in a spiral configuration as illustrated by FIG. 19A and FIG. 19B or plastic members may be implemented as illustrated by FIG. 20A and FIG. 20B. As described above, by arranging the cleaning members so that they only cover a portion of the internal circumference, the configuration provides for more flexibility and range of motion when moving the cap to clean a nozzle.

The cap described in connection with FIG. 1-FIG. 10B and the cap attachment described in connection with FIG. 11-20B may also be configured to provide for automatic cleaning as opposed to manual cleaning by hand. In these embodiments, the cap or cap attachment is configured with a switch, a button, or other mechanism that when activated will cause the cap or cap attachment to move in at least one of a vertical, horizontal, and rotational manner. The cap or cap attachment may also rotate. Such an embodiment will rely on a power source such as a battery or power cord that can be inserted into a power source.

Figure 21:
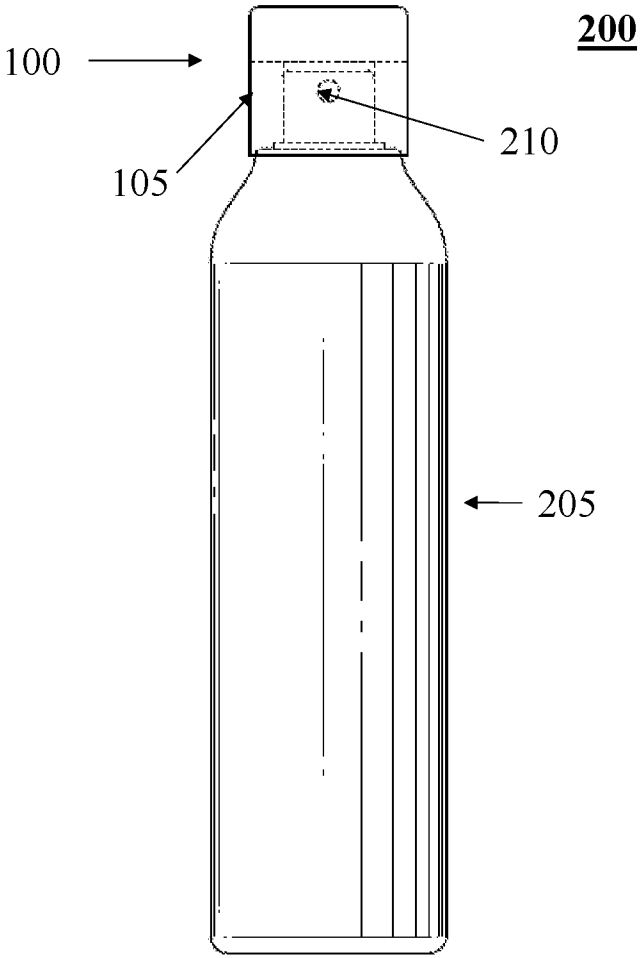
FIG. 21 is representative of one embodiment of the present disclosure illustrating the cap described in any of the above referenced figures in conjunction with an associated spray or aerosol can.
Figure 22:
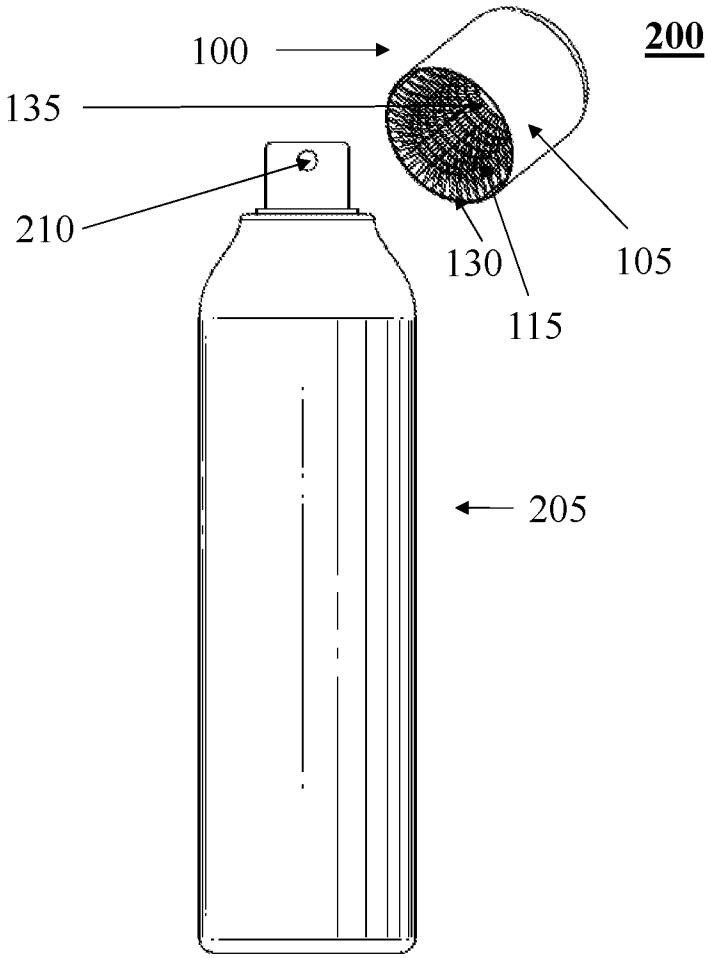
FIG. 22 is representative of one embodiment of the present disclosure illustrating the cap described in any of the above referenced figures as removed from an associated spray or aerosol can.

In another embodiment, the present disclosure provides for an assembly such as that illustrated in FIG. 21 and FIG. 22. Such an assembly 200 may comprise a canister 205, comprising one or more nozzles 210, and a cap 100 that defines a cavity 135. The cap 100 further comprises an external surface area 105 and an internal surface area 130, where the internal surface area 130 further comprises a vertical height and an internal circumference. The assembly 200 may also comprise a plurality of cleaning members arranged along at least a portion of the internal circumference and the vertical height of the internal surface area 130, where the plurality of cleaning members are configured to interact with the one or more nozzles 210 of the canister 200 for cleaning. FIG. 22 illustrates the assembly 200 with the cap 100 removed so as to illustrate the cleaning members (shown as brush members 115) affixed to the internal surface area 130.

Figure 23:
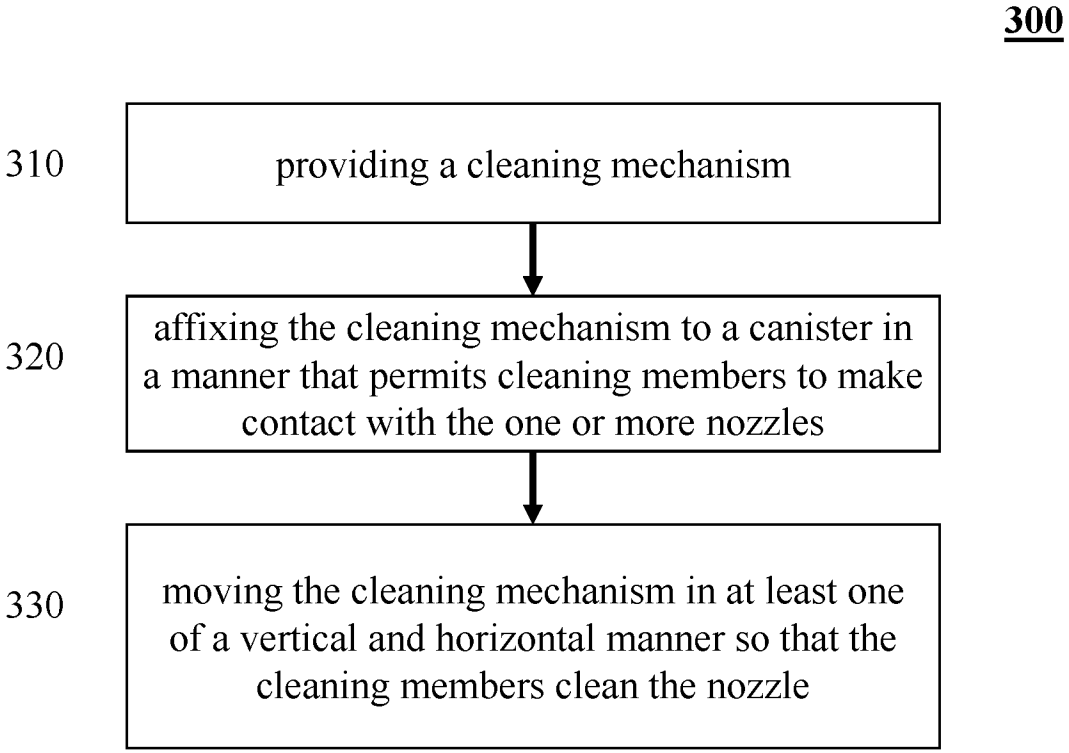
FIG. 23 is representative of one embodiment of a method of the present disclosure.

In another embodiment, the present disclosure provides for a method for cleaning a nozzle. The method 300 is illustrated by FIG. 23 and comprises providing a cleaning mechanism at step 310. The cleaning mechanism is affixed to the canister in a manner that permits cleaning members to make contact with one or more nozzles in step 320 and moving the cleaning mechanism in at least one of a vertical, horizontal, and rotational manner in step 330 so that the cleaning members clean the nozzle.

While the disclosure has been described in detail in reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A cleaning mechanism comprising:

a cap that defines a cavity and comprises an external surface area and an internal surface area, where the internal surface area further comprises a vertical height and an internal circumference; and a plurality of cleaning members arranged along at least a portion of the internal circumference and the vertical height of the internal surface area, where the plurality of cleaning members are configured to interact with one or more nozzles of a canister for cleaning.

2. The cleaning mechanism of claim 1 wherein the plurality of cleaning members are arranged to cover substantially all of the vertical height and internal circumference of the internal surface area.

3. The cleaning mechanism of claim 1 wherein the plurality of cleaning members are arranged to cover substantially all of the vertical height and internal circumference of the internal surface area in a spiral configuration.

4. The cleaning mechanism of claim 1 wherein the plurality of cleaning members are arranged to cover only a portion of the vertical height and a portion of the internal circumference of the internal surface area.

5. The cleaning mechanism of claim 1 wherein the plurality of cleaning members are arranged to cover only a portion of the vertical height and a portion of the internal circumference of the internal surface area in a spiral configuration.

6. The cleaning mechanism of claim 1 wherein the plurality of cleaning members are arranged to cover substantially all of the vertical height and only a portion of the internal circumference of the internal surface area.

7. The cleaning mechanism of claim 1 wherein the plurality of cleaning members are arranged to cover substantially all of the vertical height and only a portion of the internal circumference of the internal surface area in a spiral configuration.

8. The cleaning mechanism of claim 1 wherein the plurality of cleaning members further comprise at least one of brush members, plastic members, and combinations thereof.

9. The cleaning mechanism of claim 1 wherein cleaning of the nozzle is further achieved by moving the cap in at least one of a vertical, horizontal, and rotational manner relative to the canister.

10. The cleaning mechanism of claim 1 wherein the nozzle comprises at least one of a spray nozzle and an aerosol nozzle.

11. The cleaning mechanism of claim 1 where the mechanism is further configured for at least one of automated and manual operation.

12. A cleaning mechanism comprising:

a cap attachment that defines a cavity and comprises an external surface area and an internal surface area, where the internal surface area further comprises a vertical height and an internal circumference; and a plurality of cleaning members arranged along at least a portion of the internal circumference and the vertical height of the internal surface area, where the plurality of cleaning members are configured to interact with one or more nozzles of a canister for cleaning.

13. The cleaning mechanism of claim 12 wherein the plurality of cleaning members are arranged to cover substantially all of the vertical height and internal circumference of the internal surface area.

14. The cleaning mechanism of claim 12 wherein the plurality of cleaning members are arranged to cover substantially all of the vertical height and internal circumference of the internal surface area in a spiral configuration.

15. The cleaning mechanism of claim 12 wherein the plurality of cleaning members are arranged to cover only a portion of the vertical height and a portion of the internal circumference of the internal surface area.

16. The cleaning mechanism of claim 12 wherein the plurality of cleaning members are arranged to cover only a portion of the vertical height and a portion of the internal circumference of the internal surface area in a spiral configuration.

17. The cleaning mechanism of claim 12 wherein the plurality of cleaning members are arranged to cover substantially all of the vertical height and only a portion of the internal circumference of the internal surface area.

18. The cleaning mechanism of claim 12 wherein the plurality of cleaning members are arranged to cover substantially all of the vertical height and only a portion of the internal circumference of the internal surface area in a spiral configuration.

19. The cleaning mechanism of claim 12 wherein the plurality of cleaning members further comprise at least one of brush members, plastic members, and combinations thereof.

20. The cleaning mechanism of claim 12 wherein cleaning of the nozzle is further achieved by moving the cap attachment in at least one of a vertical, horizontal, and rotational manner relative to the canister.

21. The cleaning mechanism of claim 12 wherein the cap attachment is configured so as to slide into a cavity defined by a cap and thereby become affixed to the cap for use.

22. The cleaning mechanism of claim 12 wherein the cap attachment is configured to be used independently of a cap.

23. The cleaning mechanism of claim 12 wherein the nozzle comprises at least one of a spray nozzle and an aerosol nozzle.

24. The cleaning mechanism of claim 12 where the mechanism is further configured for at least one of automated and manual operation.

25. An assembly comprising:

a canister comprising one or more nozzles;

a cap that defines a cavity and comprises an external surface area and an internal surface area, where the internal surface area further comprises a vertical height and an internal circumference; and a plurality of cleaning members arranged along at least a portion of the internal circumference and the vertical height of the internal surface area, where the plurality of cleaning members are configured to interact with the one or more nozzles of the canister for cleaning.

26. A method for cleaning comprising:

providing a cleaning mechanism, where the cleaning mechanism:

defines a cavity and comprises an external surface area and an internal surface area, where the internal surface area further comprises a vertical height and an internal circumference, and wherein the cleaning mechanism further comprises a plurality of cleaning members arranged along at least a portion of the internal circumference and the vertical height of the internal surface area, where the plurality of cleaning members are configured to interact with the one or more nozzles of a canister;

affixing the cleaning mechanism to the canister in a manner that permits the cleaning members make contact with the one or more nozzles; and moving the cleaning mechanism in at least one of a vertical, horizontal, and rotational manner so that the cleaning members clean the nozzle.

* * * * *